US011590626B2

(12) United States Patent
Ikuta

(10) Patent No.: US 11,590,626 B2
(45) Date of Patent: Feb. 28, 2023

(54) WORK TOOL

(71) Applicant: MAKITA CORPORATION, Anjo (JP)

(72) Inventor: Hiroki Ikuta, Anjo (JP)

(73) Assignee: MAKITA CORPORATION, Anjo (JP)

( * ) Notice: Subject to any disclaimer, the term of this patent is extended or adjusted under 35 U.S.C. 154(b) by 548 days.

(21) Appl. No.: 16/624,066

(22) PCT Filed: Jun. 12, 2018

(86) PCT No.: PCT/JP2018/022483
§ 371 (c)(1),
(2) Date: Dec. 18, 2019

(87) PCT Pub. No.: WO2018/235680
PCT Pub. Date: Dec. 27, 2018

(65) Prior Publication Data

US 2021/0146497 A1 May 20, 2021

(30) Foreign Application Priority Data

Jun. 23, 2017 (JP) ..... JP2017-123293

(51) Int. Cl.
*B24B 23/02* (2006.01)

(52) U.S. Cl.
CPC ..... *B24B 23/028* (2013.01)

(58) Field of Classification Search
CPC ..... B24B 13/028
(Continued)

(56) References Cited

U.S. PATENT DOCUMENTS 2,489,365 A * 11/1949 Broussouse ..... H02K 7/1021 318/366
2,585,356 A 2/1952 Wagner
(Continued)

FOREIGN PATENT DOCUMENTS

CN 101254588 A 9/2008
CN 202269188 U 6/2012
(Continued)

OTHER PUBLICATIONS

Oct. 6, 2020 Office Action issued in Japanese Patent Application No. 2017-123293.
(Continued)

*Primary Examiner* — Robert F Long
*Assistant Examiner* — Xavier A Madison
(74) *Attorney, Agent, or Firm* — Oliff PLC

(57) ABSTRACT

A work tool includes a motor, a tool-mounting part, a rotary shaft, a rotating member, a switch, an operation member and a lock mechanism. The rotating member is held rotatably around a rotation axis of the rotary shaft and configured to transmit torque to and from the rotary shaft while being allowed to rotate relative to the rotary shaft. The rotating member is configured to rotate together with the rotary shaft by action of transmitting the torque when the operation member is moved from the OFF position to the ON position and the lock mechanism allows the rotating member to rotate, and configured to apply a braking force to the rotary shaft by action of transmitting the torque when the operation member is moved from the ON position to the OFF position and the lock mechanism non-rotatably locks the rotating member.

12 Claims, 12 Drawing Sheets

(58) Field of Classification Search
USPC ..... 188/164
See application file for complete search history.

(56) References Cited

U.S. PATENT DOCUMENTS

| | | | | |
|---|---|---|---|---|
| 3,703,654 | A * | 11/1972 | Karubian | B27B 5/38 30/369 |
| 4,434,586 | A * | 3/1984 | Muller | B24B 45/006 451/342 |
| 6,277,013 | B1 | 8/2001 | Sasaki et al. | |
| 7,537,065 | B2 * | 5/2009 | Gallagher | B24B 55/00 173/217 |
| 9,243,674 | B2 * | 1/2016 | Esenwein | B23Q 11/0092 |
| 9,546,701 | B2 * | 1/2017 | Wiker | F16D 63/006 |
| 2013/0023189 | A1 | 1/2013 | Numata | |

FOREIGN PATENT DOCUMENTS

| | | | |
|---|---|---|---|
| CN | 102886729 | A | 1/2013 |
| CN | 103079772 | A | 5/2013 |
| CN | 204082435 | U | 1/2015 |
| CN | 106115524 | A | 11/2016 |
| DE | 3741536 | A1 | 6/1989 |
| DE | 3828954 | A1 | 3/1990 |
| DE | 3722629 | C2 | 1/1995 |
| GB | 2 357 256 | A | 6/2001 |
| JP | 2000-108056 | A | 4/2000 |
| JP | 2007-118097 | A | 5/2007 |
| JP | 2007-152538 | A | 6/2007 |
| WO | 2012/019344 | A1 | 2/2012 |

OTHER PUBLICATIONS

Aug. 21, 2018 International Search Report issued in International Patent Application No. PCT/JP2018/022483.
Jan. 26, 2021 Office Action issued in Chinese Patent Application No. 201880041451.6.
May 25, 2021 Office Action issued in Chinese Patent Application No. 201880041451.6.
Dec. 24, 2019 International Preliminary Report on Patentability issued in International Patent Application No. PCT/JP2018/022483.

* cited by examiner

WORK TOOL

TECHNICAL FIELD

The present invention relates to a work tool configured to rotationally drive a tool accessory.

BACKGROUND ART

A work tool is known which is configured to perform an operation on a workpiece by rotationally driving a tool accessory by power of a motor. Some of such work tools have a mechanism for facilitating tool replacement. For example, Japanese Unexamined Patent Application Publication No. 2007-118097 discloses a disc grinder which is configured to perform an operation by a tool accessory being rotationally driven via a driving-side rotating member and a driven-side rotating member. The disc grinder is provided with a lock mechanism for locking rotation inputted from the driven side while allowing transmission of rotation inputted from the driving side.

SUMMARY OF THE INVENTION

Problem to be Solved by the Invention

The above-described lock mechanism may be suitably used to lock rotation of a spindle when an external force is inputted to the spindle in a circumferential direction when the tool accessory is replaced (before start of an operation). However, a technique is also desired which may be used not only when the tool accessory is replaced, but also to properly stop the tool accessory continuing to rotate by inertia after driving of the motor is stopped upon completion of the operation.

Accordingly, it is an object of the present invention to provide a technique for properly stopping rotation of a tool accessory after driving of a motor is stopped, in a work tool configured to rotationally drive the tool accessory.

Means for Solving the Problem

According to one aspect of the present invention, a work tool is provided which is configured to rotationally drive a tool accessory. The work tool may include a motor, a tool-mounting part, a rotary shaft, a rotating member, a switch, an operation member and a lock mechanism.

The tool-mounting part is configured to removably receive the tool accessory, and configured to rotate by power of the motor. The rotary shaft is held rotatably around a specified rotation axis and configured to rotate together with the tool-mounting part by power of the motor. The rotating member is held rotatably around the rotation axis of the rotary shaft and configured to transmit torque to and from the rotary shaft while being allowed to rotate relative to the rotary shaft. The switch is configured as a switch for driving the motor. The operation member is configured to move between an ON position, in which the operation member holds the switch in an ON state, and an OFF position, in which the operation member holds the switch in an OFF state, according to an external depressing operation. The lock mechanism is configured to allow the rotating member to rotate around the rotation axis when the operation member is in the ON position, and to lock the rotating member non-rotatably around the rotation axis when the operation member is in the OFF position.

Further, the rotating member is configured to rotate together with the rotary shaft by action of transmitting the torque when the operation member is moved from the OFF position to the ON position and the lock mechanism allows the rotating member to rotate, and configured to apply a braking force to the rotary shaft by action of transmitting the torque when the operation member is moved from the ON position to the OFF position and the lock mechanism non-rotatably locks the rotating member.

In the work tool of the present aspect, when the operation member is moved from the ON position to the OFF position, the rotating member which has been rotating together with the rotary shaft by the torque transmitting action is non-rotatably locked by the lock mechanism, so that rotation of the rotating member is stopped. Then, the rotating member applies a braking force to the rotary shaft by the torque transmitting action, so that rotation of the rotary shaft and thus rotation of the tool-mounting part rotating together with the rotary shaft can be stopped. Thus, the lock mechanism and the rotating member are sequentially actuated in interlock with movement of the operation member to the OFF position, so that the tool accessory mounted to the tool-mounting part can be prevented from continuing to rotate by inertia after driving of the motor is stopped.

The motor in the present aspect may be a direct current (DC) motor or an alternate current (AC) motor. Further, the motor may be a motor with a brush or a so-called brushless motor with no brush.

The tool-mounting part is a portion which is configured to be rotationally driven with the tool accessory mounted thereto, and typically, the tool-mounting part may be provided on a final output shaft (for example, a tool spindle which may be rotated by a motor shaft) which may be rotationally driven by power of the motor.

The rotary shaft may be the final output shaft on which the tool-mounting part is provided, or any other shaft, as long as the shaft can rotate together with the tool-mounting part by power of the motor.

The structure of the rotating member is not particularly limited, but may typically have a cylindrical (tubular) shape and disposed coaxially with the rotary shaft. Torque may be transmitted between the rotating member and the rotary shaft, for example, by utilizing friction, fluid or a magnetic field.

The structure of the lock mechanism is not particularly limited, as long as the lock mechanism can switch a state of the rotating member between a state in which the rotating member is allowed to rotate around the rotation axis and a state in which the rotating member is non-rotatably locked, in interlock with movement of the operation member between the ON position and the OFF position.

According to one aspect of the present invention, the lock mechanism may include a cylindrical member and an engagement member. The cylindrical member may be disposed radially outside of the rotating member while rotation of the cylindrical member around the rotation axis is restricted. The engagement member may be held to be movable in a circumferential direction around the rotation axis between the cylindrical member and the rotating member. The engagement member may be configured to move, in interlock with movement of the operation member, between an engaged position, in which the engagement member is held between the cylindrical member and the rotating member, and a disengaged position, in which the engagement member is loosely disposed between the cylindrical member and the rotating member. In this case, the engagement member may be configured to be placed in the disengaged position to allow rotation of the rotating member when the operation member is placed in the ON position, and configured to be placed in the engaged position to non-rotatably lock the rotating member when the operation member is placed in the OFF position.

According to the present aspect, the rotating member can be switched from a rotation-allowed state to a rotation-disabled state by movement of the engagement member in the circumferential direction interlocking with the movement of the operation member. Further, the engagement member may be held between the cylindrical member and the rotating member in the engaged position to thereby non-rotatably lock the rotating member. With such a structure, only a relatively small force may be required to move the engagement member in the circumferential direction, and in addition, rotation of the rotating member may be immediately stopped. Further, according to the present aspect, the lock mechanism can be formed compact, compared with a mechanism in which the engagement member moves in an extending direction or a radial direction of the rotation axis. Further, preferably, the engagement member may be configured to non-rotatably lock the rotating member by a wedge effect when placed in the engaged position. In other words, it may be preferable that the engagement member is disposed in a wedge-like space which is gradually narrowed toward the engaged position from the disengaged position between the cylindrical member and the rotating member.

According to one aspect of the present invention, the lock mechanism may further include a retaining member which is configured to retain the engagement member. The retaining member may be connected to the operation member and may be disposed radially outside of the rotating member and radially inside of the cylindrical member so as to be rotatable around the rotation axis within a specified rotation range. The retaining member may be configured to move the engagement member between the engaged position and the disengaged position in the circumferential direction by rotating around the rotation axis in interlock with movement of the operation member. It is noted that the retaining member may be connected to the operation member directly or via an intervening member.

According to one aspect of the present invention, the lock mechanism may further include a first biasing member which is configured to bias the retaining member in a first rotation direction. The retaining member may be configured to place the engagement member in the engaged position by being rotated to a first retaining position in the first rotation direction by a biasing force of the first biasing member, in interlock with the movement of the operation member from the ON position to the OFF position, and to place the engagement member in the disengaged position by being rotated to a second retaining position in a second rotation direction opposite to the first rotation direction against the biasing force, in interlock with movement of the operation member from the OFF position to the ON position.

According to one aspect of the present invention, the rotary shaft may have a first frictional-engagement part, and the rotating member may have a second frictional-engagement part. The first frictional-engagement part may have a friction surface and may be configured to rotate together with the rotary shaft. Further, the second frictional-engagement part may have a friction surface and may be configured to rotate together with the rotating member. The torque may be transmitted between the rotating member and the rotary shaft by friction between the friction surface of the first frictional-engagement part and the friction surface of the second frictional-engagement part.

According to the present aspect, the torque can be transmitted between the rotating member and the rotary shaft by friction between the friction surfaces of the first and second frictional-engagement parts. Specifically, when rotation of the rotating member is allowed, the second frictional-engagement part may be frictionally engaged with the first frictional-engagement part which rotates together with the rotary shaft, and rotate together with the first frictional-engagement part, so that the rotating member may also rotate. Thereafter, when the rotating member is non-rotatably locked, a braking force can be applied to the rotary shaft via the first frictional-engagement part, by frictional resistance between the second frictional-engagement part of the rotating member and the first frictional-engagement part. Therefore, after the rotating member is locked, the rotary shaft and the tool-mounting part would not be suddenly stopped, but can be gradually decelerated and stopped. According to the present aspect, time required to stop can be appropriately set by selecting, for example, the material of the friction surfaces of the first and second frictional-engagement parts.

The first and second frictional-engagement parts may be arranged side by side in the rotation axis direction. The work tool may further include a second biasing member which is configured to bias at least one of the first frictional-engagement part and the second frictional-engagement part in a direction to bring the friction surface of the first frictional-engagement part and the friction surface of the second frictional-engagement part into contact with each other. Further, the friction surface of the first frictional-engagement part and the friction surface of the second frictional-engagement part may be normally held in contact with each other by a biasing force of the second biasing member.

According to one aspect of the present invention, each of the first frictional-engagement part and the second frictional-engagement part may be configured as a friction plate having the friction surface on either side. Further, a plurality of the first frictional-engagement parts and a plurality of the second frictional-engagement parts may be provided and alternately arranged in the rotation axis direction. In other words, a multi-plate frictional brake mechanism may be adopted. According to the present aspect, compared with a case in which only each one of the first and second frictional-engagement parts are provided (in other words, a single-plate frictional brake mechanism is adopted), stress to be applied to each friction surface can be reduced, so that the life of each of the first and second frictional-engagement parts can be extended. Further, the first and second frictional-engagement parts can transmit relatively large torque for the size in the radial direction.

According to one aspect of the present invention, the lock mechanism may be configured to be switched from a lock state of non-rotatably locking the rotating member to an unlock state of allowing the rotating member to rotate, before the operation member reaches the ON position from the OFF position. According to the present aspect, driving of the motor can be started after the rotating member is allowed to rotate together with the rotary shaft by the torque transmitting action, that is, after the rotary shaft is turned to a state that the braking force is not applied thereto. Therefore, the rotary shaft and thus the tool-mounting part can be smoothly rotated from the start of driving of the motor.

According to one aspect of the present invention, the motor may include a stator, a rotor and a motor shaft extending from the rotor. The rotary shaft and the motor shaft may be coaxially connected to each other while a conical tapered part formed in one end portion of one of the rotary shaft and the motor shaft is engaged with a conical tapered hole formed in one end portion of the other of the rotary shaft and the motor shaft. According to the present aspect, the rotary shaft and the motor shaft can be connected by engagement of the tapered part and the tapered hole, so that the rotation axes of the rotary shaft and the motor shaft can be easily aligned with each other with high accuracy.

According to one aspect of the present invention, the work tool may include a motor housing. The motor housing houses the motor such that the motor shaft extends in a front-rear direction. Further, a rear end portion of the motor housing has an opening. The rotary shaft may be connected to a rear end part portion the motor shaft and may extend rearward through the opening. The work tool may further include a dustproof member which is fixed to the rotary shaft rearward of the opening and which is configured to prevent dust from entering the motor housing through the opening. According to the present aspect, dust can be prevented from entering the motor housing through the opening which is formed in the rear end portion of the motor housing for connection with the rotary shaft. It is noted that the dustproof member may be configured, for example, to form a labyrinth structure or the dustproof member may have a filter.

According to one aspect of the present invention, a work tool is provided which is configured to rotationally drive a tool accessory. This work tool may include a motor, a tool-mounting part, a rotary shaft, a switch, an operation member and a brake system.

The tool-mounting part is configured to removably receive the tool accessory, and configured to rotate by power of the motor. The rotary shaft is held rotatably around a specified rotation axis and configured to rotate together with the tool-mounting part by power of the motor. The switch is configured as a switch for driving the motor. The operation member is configured to move between an ON position, in which the operation member holds the switch in an ON state, and an OFF position, in which the operation member holds the switch in an OFF state, according to an external depressing operation. The brake system is configured to brake the rotary shaft. The brake system includes a first brake mechanism and a second brake mechanism which are configured to operate in series. The first brake mechanism is configured to actuate the second brake mechanism in interlock with movement of the operation member from the ON position to the OFF position. The second brake mechanism is configured to be actuated by the first brake mechanism to apply a braking force to the rotary shaft.

According to the present aspect, when the operation member is moved from the ON position to the OFF position and the switch is placed in the OFF state, the first brake mechanism actuates the second brake mechanism and the second brake mechanism applies a braking force to the rotary shaft. Therefore, by appropriately setting the operation of the first brake mechanism which interlocks with the operation member and the operation of the second brake mechanism which brakes the rotary shaft, the rotary shaft can be stopped at a desired timing while operability of the operation member can be improved. It is noted that it may be preferable to employ different types of brake mechanisms as the first and second brake mechanisms.

According to one aspect of the present invention, the second brake mechanism may be configured as a frictional brake mechanism including a first frictional-engagement part and a second frictional-engagement part. The first frictional-engagement part may be disposed to rotate together with the rotary shaft. The second frictional-engagement part may be normally held in contact with the first frictional-engagement part. The first brake mechanism may be configured as a lock mechanism including an engagement member which is configured to engage with the second frictional-engagement part. The engagement member may be configured to stop rotation of the second frictional-engagement part which rotates together with the first frictional-engagement part in frictional engagement with the first frictional-engagement part, by engaging with the second frictional-engagement part in interlock with movement of the operation member from the ON position to the OFF position. The second frictional-engagement part may be configured to apply the braking force to the rotary shaft via the first frictional-engagement part when the engagement member stops rotation of the second frictional-engagement part.

According to one aspect of the present invention, the second brake mechanism may include a torque-transmission part which is configured to transmit torque to and from the rotary shaft. Further, the second brake mechanism may include a dustproof structure for preventing dust from entering the torque transmission part. According to the present aspect, malfunction of the torque-transmission part which may otherwise be caused by dust can be prevented. It is noted that, as the dustproof structure, for example, a cover which covers the torque-transmission part or a structure in which components of the torque-transmission part are arranged in close contact may be adopted.

MODES FOR CARRYING OUT THE INVENTION

An embodiment of the present invention is now described with reference to the drawings. In the following embodiment, a hand-held electric disc grinder (hereinafter simply referred to as a grinder) 1 is described as an example of a work tool which is configured to rotationally drive a tool accessory.

Figure 1:
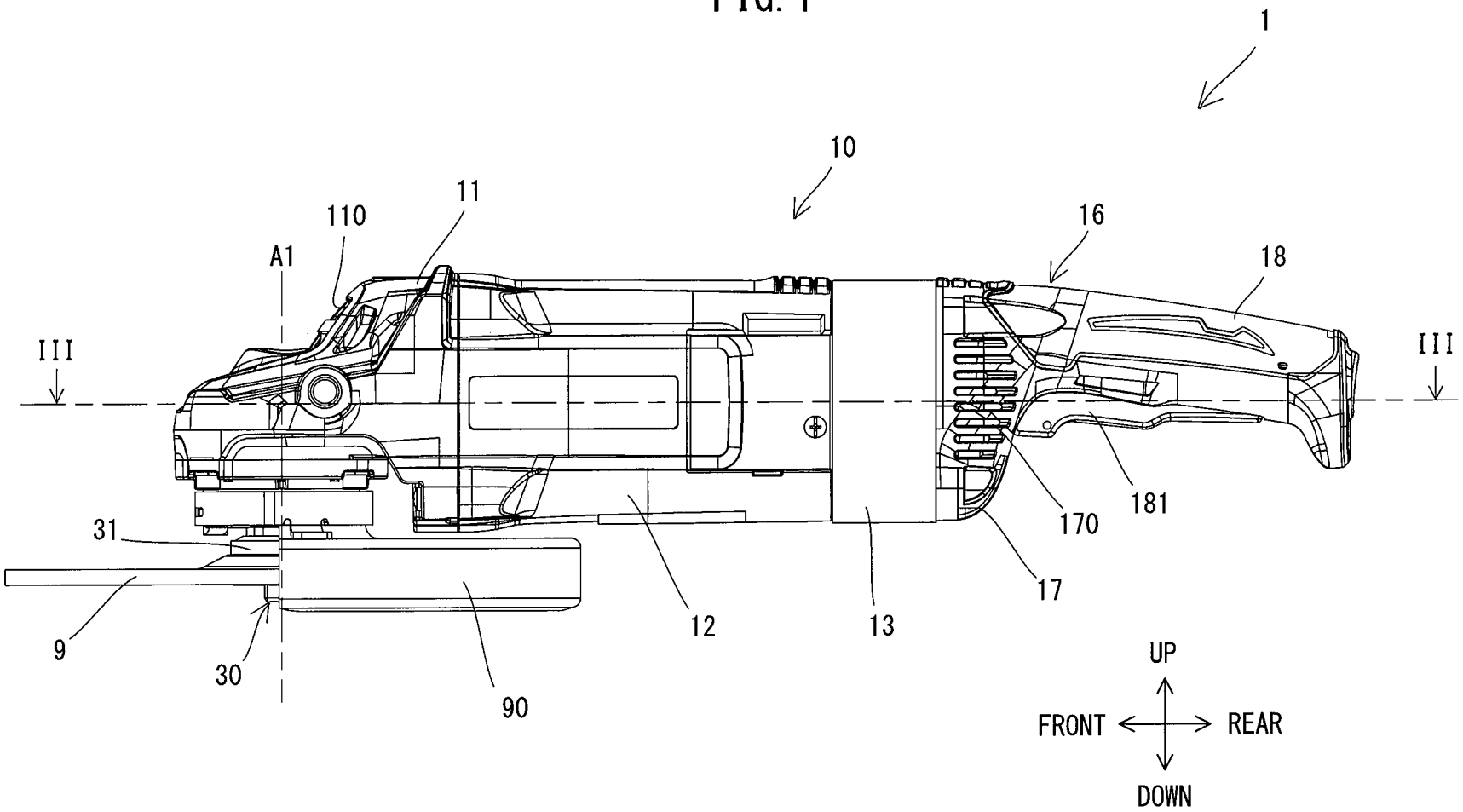
FIG. 1 is a side view of a grinder.

First, the general structure of the grinder 1 is described with reference to FIG. 1. As shown in FIG. 1, an outer shell of the grinder 1 is formed by a housing 10. The housing 10 is configured as an elongate hollow body as a whole.

In the present embodiment, a spindle 30 for driving a tool accessory 91 is disposed in one end portion of the housing 10 in a longitudinal direction such that its rotation axis A1 extends in a direction crossing (more specifically, a direction substantially orthogonal to) the longitudinal direction of the housing 10. One end portion of the spindle 30 is exposed from the housing 10 to the outside and configured as a tool-mounting part 31 which is configured to removably receive the tool accessory 9. The other end portion of the housing 10 is formed to have a smaller diameter than the other part of the housing 10 and forms a grip part 18 configured to be held by a user. The grip part 18 has a trigger 181 which is configured to be externally depressed.

The grinder 1 is configured to rotationally drive the disc-like tool accessory 9 mounted to the tool-mounting part 31. A grindstone, a rubber pad, a brush and a blade are available as the tool accessory 9 which can be mounted to the grinder 1. A user may select an appropriate tool accessory 9 according to a desired operation and mount it to the grinder 1. FIG. 1 shows an example of the grinder 1 with a grindstone mounted thereto as the tool accessory 9. When the trigger 181 is depressed by a user, the tool accessory 9 is rotationally driven and an operation such as grinding, polishing and cutting may be performed on a workpiece.

The detailed structure of the grinder 1 is now described. In the following description, for convenience of explanation, an extending direction of the rotation axis A1 of the spindle 30 (hereinafter simply referred to as a rotation-axis-A1 direction) is defined as an up-down direction of the grinder 1. In the up-down direction, the side of one end portion of the spindle 30 on which the tool-mounting part 31 is provided is defined as a lower side, while the opposite side is defined as an upper side. Further, a direction which is orthogonal to the rotation axis A1 of the spindle 30 and which corresponds to a longitudinal axis of the housing 10 is defined as a front-rear direction of the grinder 1. In the front-rear direction, the side of one end part portion the housing 10 in which the spindle 30 is disposed is defined as a front side, while the opposite side (the side on which the grip part 18 is provided) is defined as a rear side. Further, a direction which is orthogonal to the up-down direction and the front-rear direction is defined as a left-right direction.

In the present embodiment, the housing 10 includes a gear housing 11, a motor housing 12, a brake housing 13 and a handle housing 16 in this order from a front end side. The gear housing 11, the motor housing 12, the brake housing 13 and the handle housing 16 are connected together at their respective parts adjacent to each other with screws and thus form a single housing 10 as a whole. The structure of each of these parts and its internal structure are now described.

Figure 2:
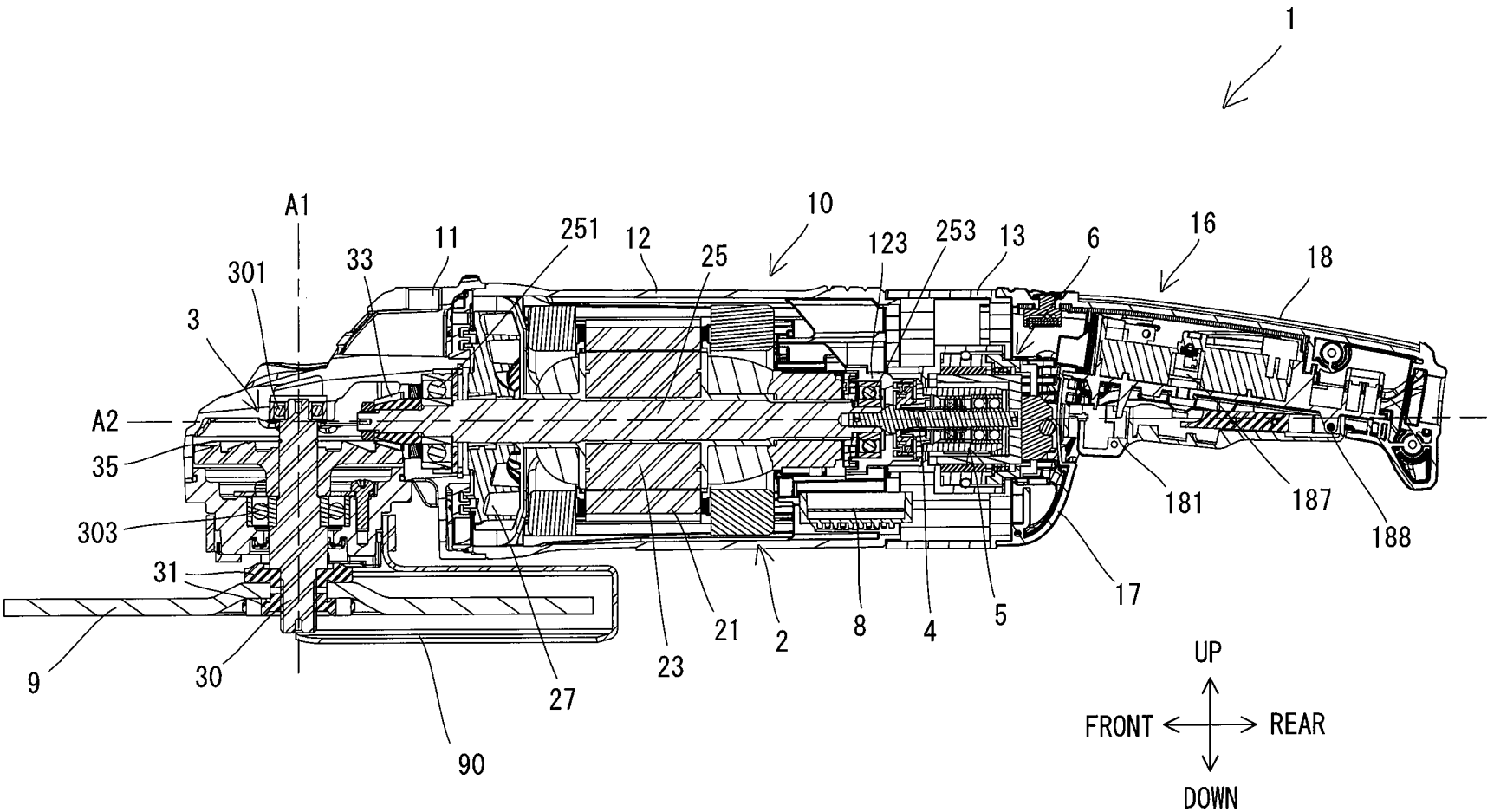
FIG. 2 is a longitudinal section of the grinder.
Figure 3:
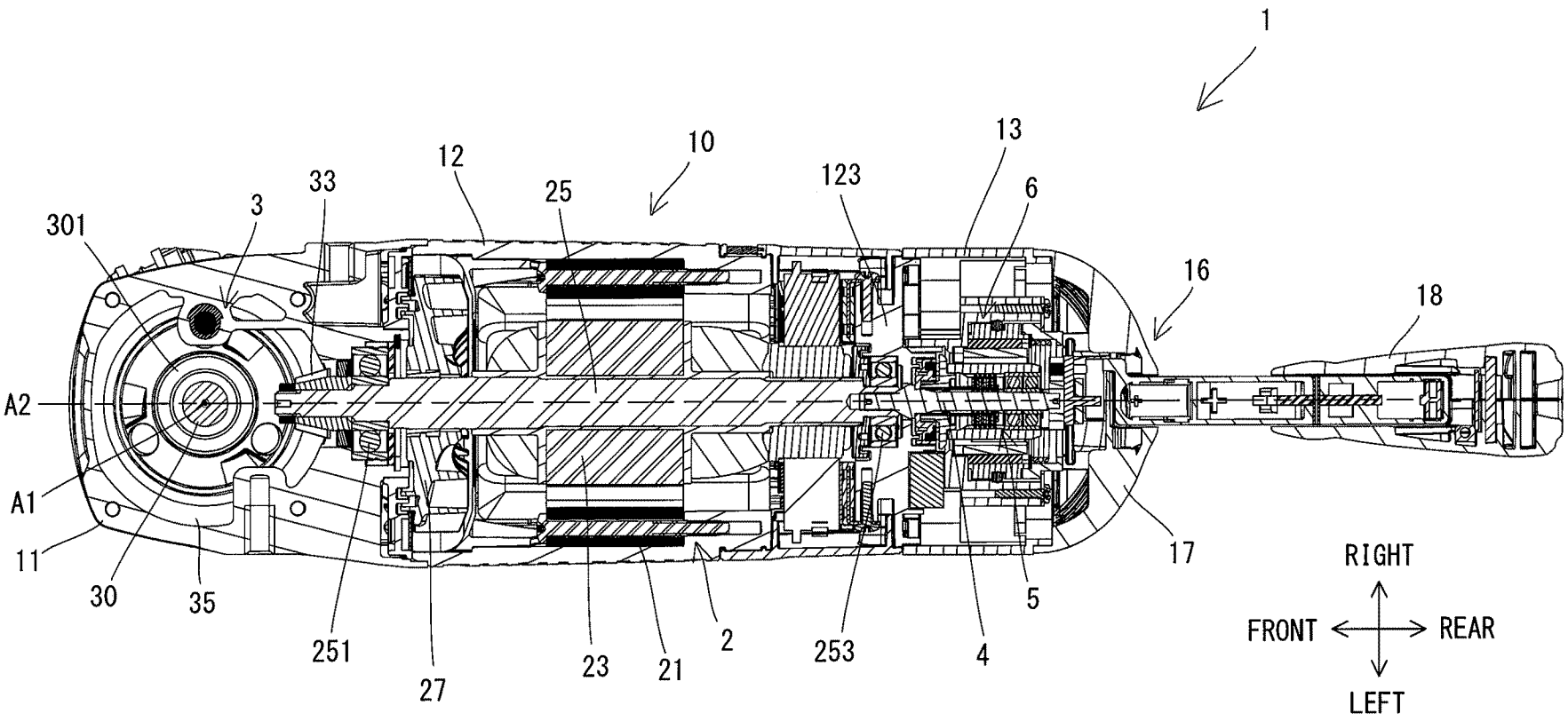
FIG. 3 is a sectional view taken along line in FIG. 1.

The motor housing 12 and its internal structure are first described. As shown in FIGS. 2 and 3, the motor housing 12 forms a central portion of the housing 10 in the front-rear direction and has a generally cylindrical shape. A motor 2 is housed within the motor housing 12. In the present embodiment, an AC motor is employed as the motor 2 which serves as a driving source of the tool accessory 9. The motor 2 may be driven by power supply from an external AC power source via a power cable (not shown). The motor 2 includes a stator 21, a rotor 23 and a motor shaft 25. The motor shaft 25 extends from the rotor 23 and rotates together with the rotor 23. The motor 2 is arranged such that a rotation axis A2 of the motor shaft 25 extends in a direction crossing the rotation axis A1 of the spindle 30. In the present embodiment, the rotation axis A2 extends in the front-rear direction (the longitudinal direction of the housing 10), orthogonal to the rotation axis A1.

Front and rear end portions of the motor shaft 25 are rotatably supported by bearings 251, 253, respectively. In the present embodiment, ball bearings are employed as the bearings 251, 253. The front bearing 251 is supported by a rear end portion of the gear housing 11 to be described later. A front end portion of the motor shaft 25 protrudes into the gear housing 11. The rear bearing 253 is supported by a bearing holding part 123 provided in a rear end portion of the motor housing 12. In the present embodiment, a rotation direction of the motor shaft 25 is set to one direction, which is a clockwise direction in a rear view.

A fan 27 for cooling the motor 2 is fixed to the motor shaft 25 between the rotor 23 and the front bearing 251. The fan 27 is configured to rotate together with the motor shaft 25 to thereby generate an air flow flowing through the housing 10. Specifically, as shown in FIG. 1, inlets 170 are formed in the handle housing 16 (specifically, a rear cover part 17) and outlets 110 are formed in the gear housing 11. When the fan 27 is rotated by driving of the motor 2, air is led into the housing 10 through the rear inlets 170 and flows forward around the motor 2 and then flows out to the outside through the front outlets 110. This air flow functions as cooling air for cooling the motor 2.

As shown in FIG. 2, a controller 8 is housed in the rear end portion of the motor housing 12. In the present embodiment, the controller 8 has a microcomputer which includes a CPU, a ROM and a RAM, etc. The controller 8 is electrically connected to a switch 187 and a rotation position sensor 45 (see FIG. 5) which will be described later, via a wiring (not shown). The controller 8 is configured to drive the motor 2 by energization to the motor 2 when the trigger 181 is depressed and the switch 187 is turned on. Further, the controller 8 is configured to stop driving of the motor 2 by stopping energization to the motor 2 when the operation of depressing the trigger 181 is released and the switch 187 is turned off.

The gear housing 11 and its internal structure are now described. As shown in FIGS. 2 and 3, the gear housing 11 forms a front end portion of the housing 10. A driving mechanism 3 which is configured to rotationally drive the tool accessory 9 by power of the motor 2 is housed in the gear housing 11. In the present embodiment, the driving mechanism 3 includes the spindle 30, a small bevel gear 33 and a large bevel gear 35.

The spindle 30 is disposed in a front end portion of the gear housing 11 and extends in the up-down direction. An upper end portion and a central portion of the spindle 30 are rotatably supported by bearings 301, 303 which are supported by the gear housing 11, respectively. The tool-mounting part 31 includes two flanges which protrude downward from a lower end portion of the gear housing 11. The tool-mounting part 31 is configured to hold the tool accessory 9 between the upper and lower flanges so as to fix the tool accessory 9 relative to the spindle 30. The structure of the tool-mounting part 31 is known and therefore, its detailed description is omitted here. The small bevel gear 33 is fixed to the front end portion of the motor shaft 25 protruding into the gear housing 11 and rotates together with the motor shaft 25. The large bevel gear 35 is fixed to the spindle 30 between the bearings 301, 303 and rotates together with the spindle 30. The small bevel gear 33 and the large bevel gear 35 are engaged with each other and form a speed reducing mechanism.

The speed of rotation of the motor 2 is reduced by the small bevel gear 33 and the large bevel gear 35 and then the rotation is transmitted to the spindle 30. Thus, when the motor 2 is driven, the spindle 30 is rotated around the rotation axis A1 and the tool accessory 9 fixed to the tool-mounting part 31 is rotationally driven together with the spindle 30.

A wheel cover 90 (not shown in FIG. 3) is fixed to a lower end portion of the gear housing 11 and provided to prevent scattering of chips and dust of the workpiece which are generated during operation and to protect a user from the tool accessory 9. The structure of the wheel cover 90 is known and therefore, its detailed description is omitted here.

Figure 4:
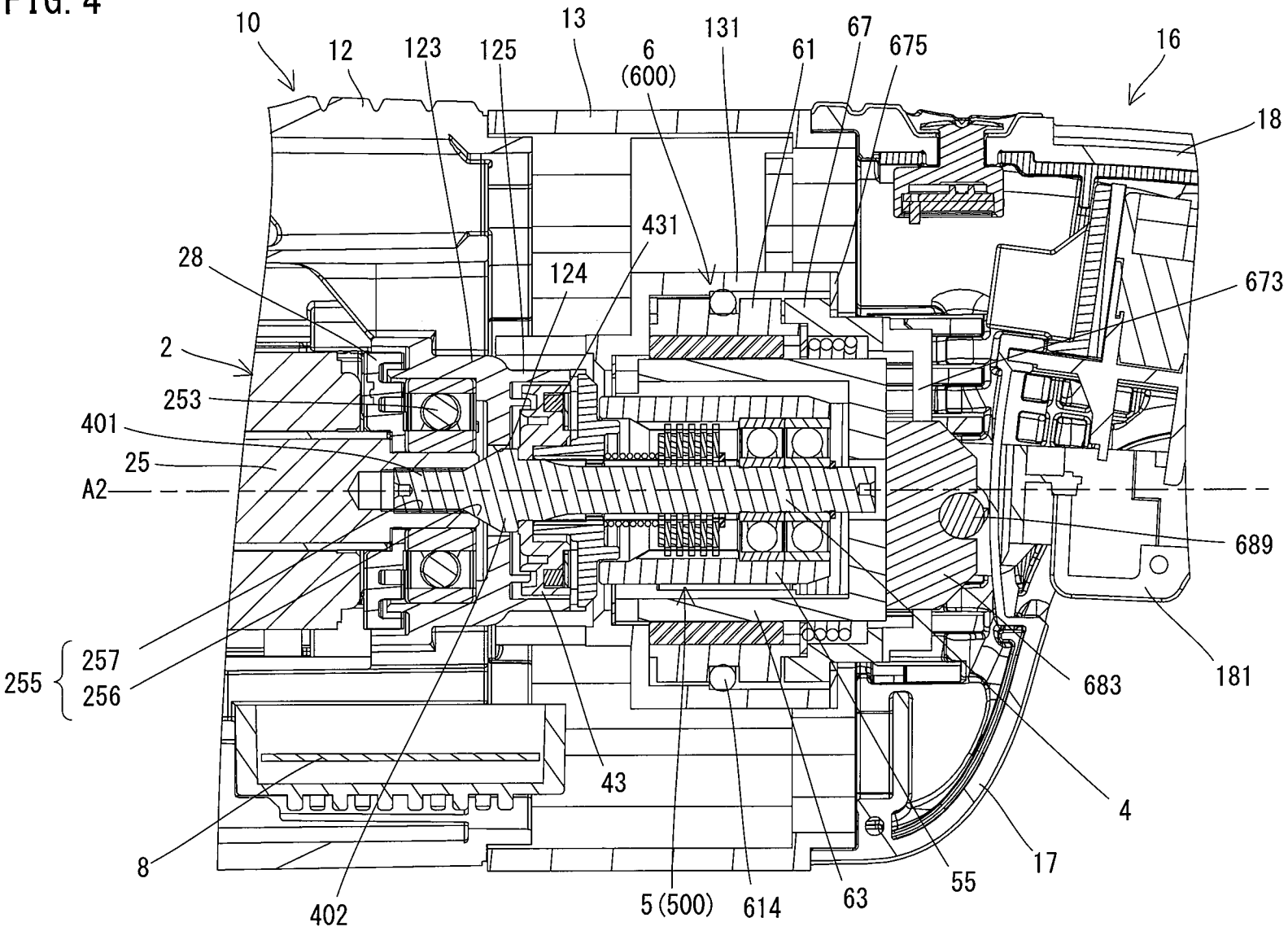
FIG. 4 is a partial, enlarged view of FIG. 2.

The brake housing 13 and its internal structure are described. The brake housing 13 is disposed on the rear side of the motor housing 12 and has a cylindrical shape having substantially the same diameter as the motor housing 12. As shown in FIG. 4, a brake shaft 4, a brake mechanism 5 and a lock mechanism 6 are housed in the brake housing 13.

The brake shaft 4 is coaxially connected to a rear end portion of the motor shaft 25 and extends rearward. The brake shaft 4 is supported by a bearing 253 so as to be rotatable together with the motor shaft 25. The brake mechanism 5 which is configured to apply a braking force to the brake shaft 4 is provided on a rear portion of the brake shaft 4. In the present embodiment, the brake mechanism 5 is configured as a multi-plate brake mechanism having a plurality of friction plates. The lock mechanism 6 is disposed radially outside the brake mechanism 5. The lock mechanism 6 is configured to actuate the brake mechanism 5 in interlock with the depressing operation of the trigger 181. The structures of the brake shaft 4, the brake mechanism 5 and the lock mechanism 6 will be described later in detail.

The handle housing 16 and its internal structure are now described. As shown in FIGS. 2 and 3, the handle housing 16 forms a rear end portion of the housing 10. In the present embodiment, the handle housing 16 includes a rear cover part 17 and the grip part 18. The rear cover part 17 is formed to have substantially the same diameter as the motor housing 12 and the brake housing 13. The grip part 18 is formed to have a smaller diameter than the rear cover part 17 and extends rearward from an upper portion of the rear cover part 17. It is noted that, in the present embodiment, the rear cover part 17 and the grip part 18 are integrally formed with each other.

A rear end portion of the lock mechanism 6 is disposed within the rear cover part 17. The switch 187 for energizing the motor 2 (i.e. for driving the tool accessory 9) is housed in the grip part 18. A rear end portion of the trigger 181 is connected to a rear end portion of the grip part 18 via a pin 188. The trigger 181 can be turned around the pin 188 in the up-down direction. The trigger 181 is normally biased downward by a biasing member (not shown) and held in a lowest position within a turning range. At this time, the switch 187 is held in an OFF state in which the motor 2 is not energized. The lowest position of the trigger 181 is hereinafter also referred to as an OFF position. When the trigger 181 is depressed by a user and turned to a specified position within the turning range, the switch 187 is switched to an ON state. The specified position where the switch 187 is switched to the ON state is hereinafter also referred to as an ON position. Further, a front end portion of the trigger 181 is connected to a slider 68 (see FIG. 7) of the lock mechanism 6, which will be described later in detail. The slider 68 may move according to movement of the trigger 181.

The detailed structure of the brake shaft 4 and a manner of connecting the brake shaft 4 with the motor shaft 25 are now described.

Figure 5:
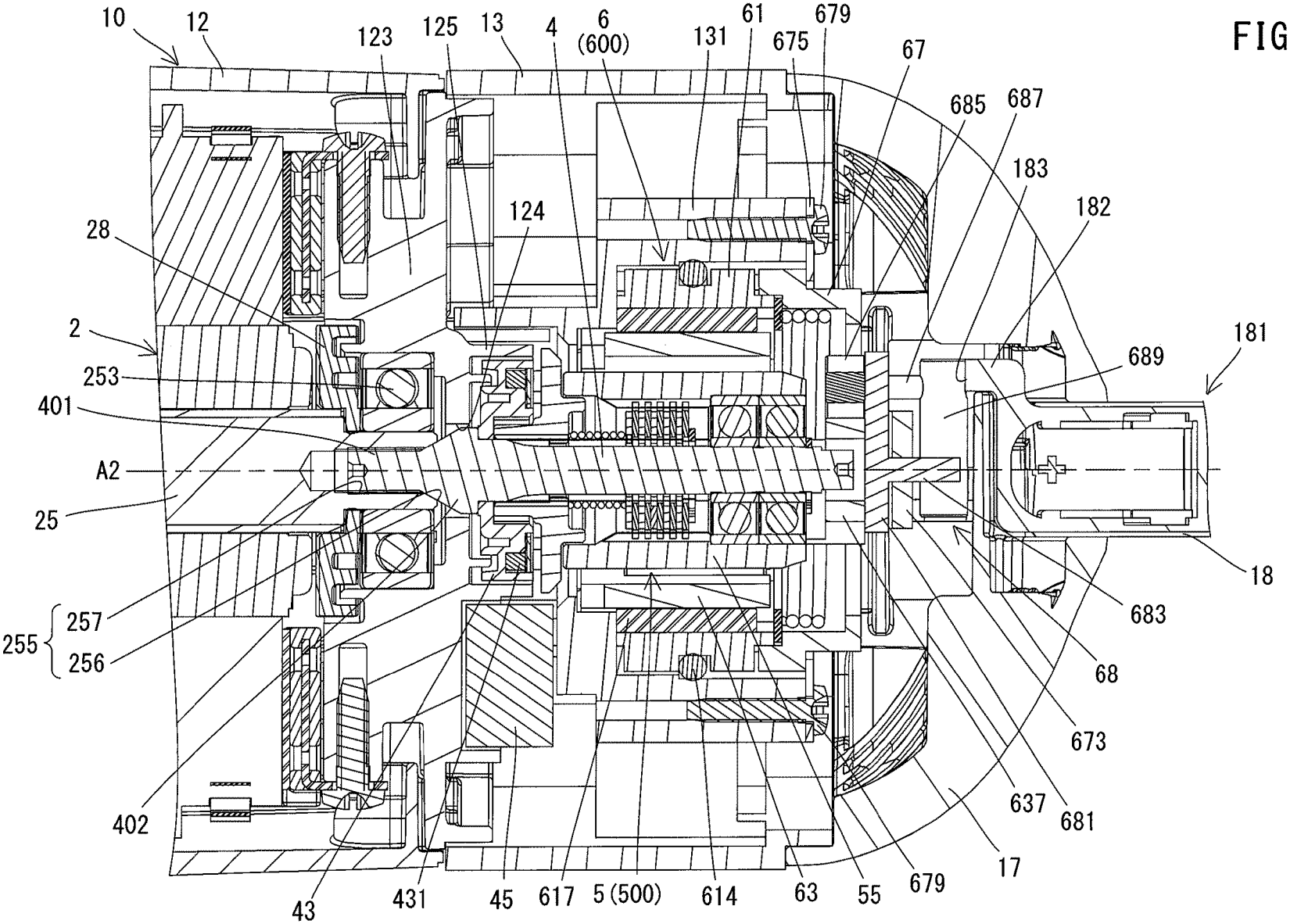
FIG. 5 is a partial, enlarged view of FIG. 3.

As shown in FIGS. 4 and 5, a connection hole 255 is formed in the rear end portion of the motor shaft 25. The connection hole 255 extends forward from a rear end of the motor shaft 25 along the rotation axis A2. An end portion of the connection hole 255 on the opening side (on the rear end side of the motor shaft 25) is formed to be enlarged in diameter toward the rear (such that its cross section orthogonal to the rotation axis A2 is enlarged toward the rear). More specifically, the end portion of the connection hole 255 on the opening side is configured as a conical tapered hole 256. A front portion of the connection hole 255 which extends forward from the tapered hole 256 is configured as a threaded hole 257. A front end portion of the brake shaft 4 is configured as a male thread part 401 which can be threadedly engaged with the threaded hole 257. Further, a portion rearward of the male thread part 401 is configured as a tapered part 402 which can be fitted in the tapered hole 256. Specifically, the tapered part 402 has a conical shape reduced in diameter toward the front.

Figure 6:
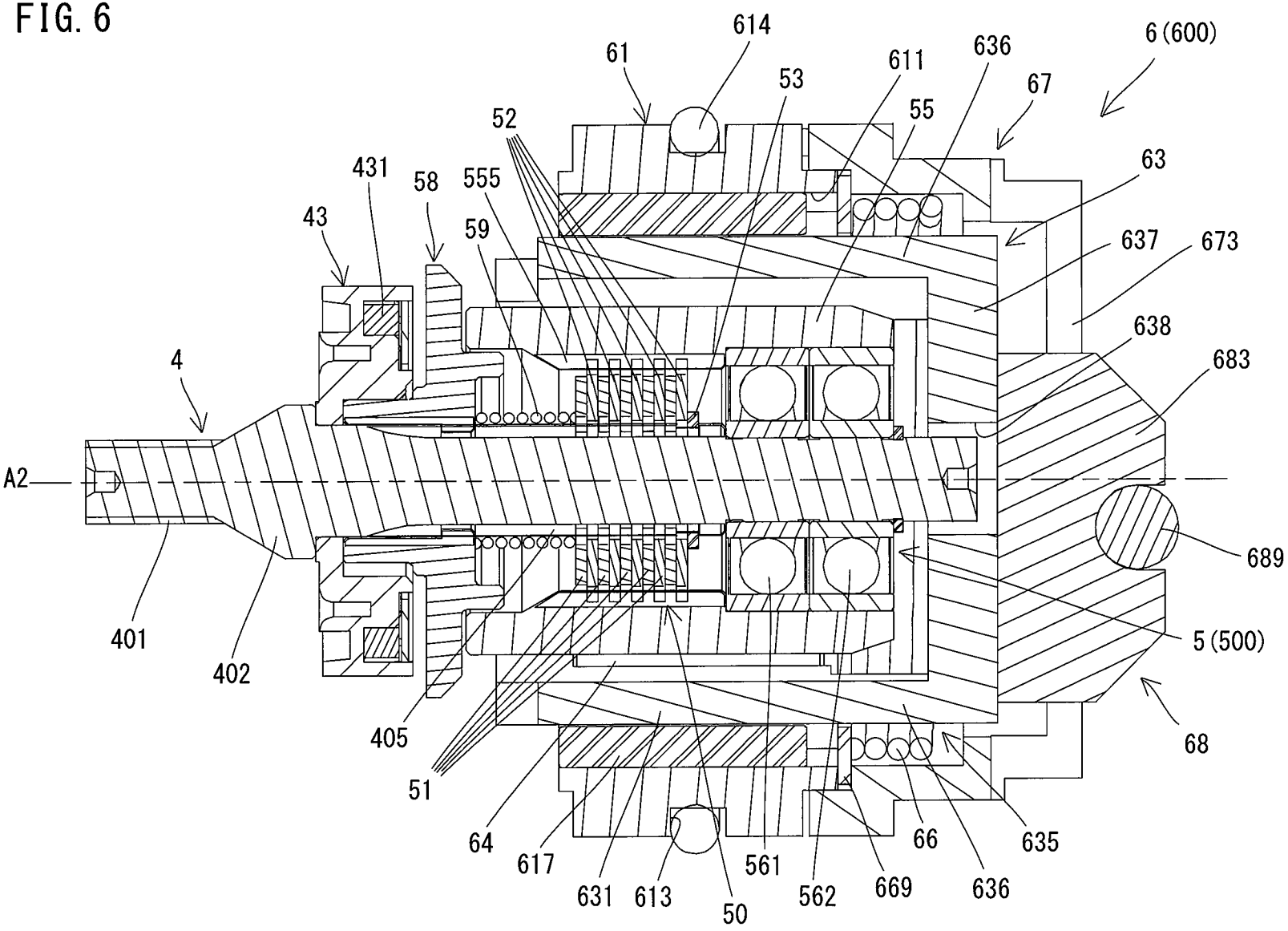
FIG. 6 is a longitudinal section of a brake assembly and a lock assembly.

As shown in FIG. 6, the brake shaft 4 is configured to be spline-fitted to first friction plates 51 to be described later. More specifically, spline teeth 405 are formed on an outer periphery of a central portion of the brake shaft 4 and protrude radially outward. The spline teeth 405 are arranged at equal intervals in a circumferential direction and extend in an axial direction of the brake shaft 4 (the rotation axis A2 direction).

As shown in FIGS. 4 and 5, when the front end portion of the brake shaft 4 is inserted into the connection hole 255 of the motor shaft 25 and the male thread part 401 is threadedly engaged with the threaded hole 257, the brake shaft 4 and the motor shaft 25 are connected to each other while the tapered part 402 is fitted in the tapered hole 256. By provision of such a connecting structure, the brake shaft 4 and the motor shaft 25 can be easily integrated with each other while an axis of the brake shaft 4 and an axis of the motor shaft 25 are aligned with each other with high accuracy. Further, the screwing direction of the male thread part 401 into the threaded hole 257 is set to a direction opposite to the rotation direction of the motor shaft 25. By this setting, the male thread part 401 is spontaneously screwed when the brake shaft 4 is braked via the lock mechanism 6 and the brake mechanism 5, which will be described later. Connected portions of the motor shaft 25 and the brake shaft 4 are supported by the bearing 253. By provision of the above-described structure, the brake shaft 4 integrated with the motor shaft 25 rotates together with the spindle 30 which is rotationally driven by the motor shaft 25.

The rear end portion of the motor housing 12 includes the bearing holding part 123 for holding the bearing 253. Foreign matter such as dust may enter the housing 10 together with the air flow (cooling air) generated by the fan 27. In order to protect the motor 2 and the bearing 253 from such foreign matter, it may be preferable that the bearing holding part 123 is sealed from the outside. In the present embodiment, as described above, the brake shaft 4 is connected to the rear end portion of the motor shaft 25 and extends rearward, and therefore an opening 124 is formed in a central portion of a rear wall of the bearing holding part 123. The brake shaft 4 (the tapered part 402) is loosely inserted through the opening 124.

Further, a dustproof member 43 is fixed on an outer periphery of the brake shaft 4. The dustproof member 43 is disposed on the rear side of the tapered part 402 and protrudes radially outward from the brake shaft 4. The dustproof member 43 has a recess which is recessed rearward from a front end surface, and a recess which is recessed forward from a rear end surface. A cylindrical projection 125 protrudes from a rear end surface of the bearing holding part 123 in such a manner as to surround the opening 124. The dustproof member 43 is loosely fitted inside the projection 125 and can rotate together with the brake shaft 4 (i.e., together with the rotor 23 and the motor shaft 25) in non-contact with the projection 125. With such a structure, the dustproof member 43 forms, together with the projection 125, a labyrinth structure for preventing dust from entering the motor housing 12 through the opening 124. Further, a dustproof member 28 having a labyrinth structure is also disposed between the bearing 253 and a rear end of the rotor 23. The dustproof members 43, 28 can protect the motor 2 and the bearing 253 from dust.

In the present embodiment, the dustproof member 43 also functions as a member for holding magnets 431 which are used for detecting a rotation position (rotation angle) of the rotor 23. Specifically, four magnets 431 are embedded in the dustproof member 43 at equal intervals in a circumferential direction. A rotation position sensor 45 (see FIG. 5) is disposed radially outside the projection 125. In the present embodiment, a Hall IC is employed as the rotation position sensor 45. The Hall IC can detect the rotation position of the rotor 23 by using the magnets 431 of the dustproof member 43 which rotates together with the rotor 23. It is noted that the rotation position sensor 45 is held by a recess formed in a rear end surface of the motor housing 12.

Figure 7:
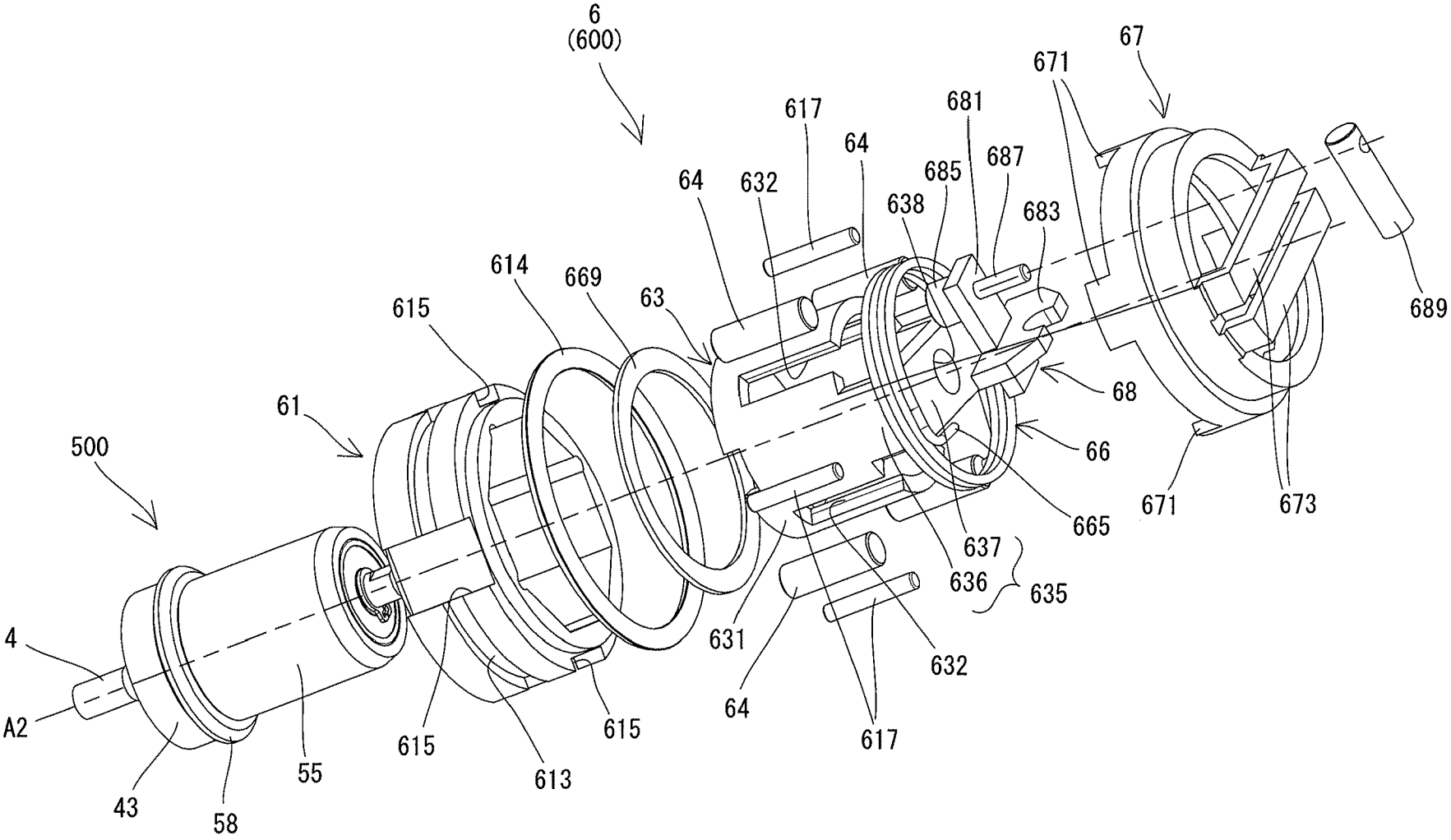
FIG. 7 is an exploded perspective view of the brake assembly and the lock assembly.

The structure of the brake mechanism 5 is now described in detail. The brake mechanism 5 is a mechanism which is capable of applying a braking force to the brake shaft 4. As shown in FIG. 6, in the present embodiment, the brake mechanism 5 is configured as a multi-plate brake mechanism mainly including a plurality of first friction plates 51 and a plurality of second friction plates 52. More specifically, the brake mechanism 5 includes the first friction plates 51, the second friction plates 52, a brake sleeve 55, two bearings 561, 562, a base part 58 and a biasing spring 59. Further, in the present embodiment, the brake mechanism 5 is integrated with the brake shaft 4 and the dustproof member 43 and forms a brake assembly 500 as shown in FIG. 7.

As shown in FIG. 6, the first friction plates 51 are disposed to be movable in the axial direction of the brake shaft 4 and to be non-rotatable around the axis. More specifically, each of the first friction plates 51 is formed as an annular plate having friction surfaces on both sides, and has spline grooves (not shown) in its inner periphery. The spline teeth 405 formed on the outer periphery of the brake shaft 4 are fitted in the spline grooves of the first friction plates 51, so that the brake shaft 4 is spline-fitted to the first friction plates 51.

The brake sleeve 55 has a cylindrical shape and has an inner diameter larger than the outer diameter of the first friction plate 51. Two bearings 561, 562 are fixed on an outer periphery of a rear end portion of the brake shaft 4. The brake sleeve 55 is rotatably supported by the bearings 561, 562 to be coaxial with the brake shaft 4. Thus, the brake sleeve 55 is rotatable around the rotation axis A2 relative to the housing 10 (see FIG. 4) and is also allowed to rotate relative to the brake shaft 4. Further, spline teeth 555 are formed on an inner periphery of a central portion of the brake sleeve 55 and protrude radially inward. The spline teeth 555 are arranged at equal intervals in the circumferential direction and extend in the axial direction of the brake sleeve 55 (the rotation axis A2 direction).

Like the first friction plates 51, the second friction plates 52 are arranged to be movable in the axial direction of the brake shaft 4 and to be non-rotatable around the axis. More specifically, each of the second friction plates 52 is formed as an annular plate having friction surfaces on both sides and has spline grooves (not shown) in its outer periphery. The spline teeth 555 provided on the inner periphery of the brake sleeve 55 are fitted in the spline grooves of the second friction plates 52, so that the brake sleeve 55 is spline-fitted to the second friction plates 52. The inner diameter of the second friction plate 52 is set such that the second friction plates 52 do not come into contact with the spline teeth 405 of the brake shaft 4.

The first friction plates 51 and the second friction plates 52 are alternately arranged in the axial direction of the brake shaft 4 (i.e. the extending direction of the rotation axis A2, the front-rear direction). In this arrangement, one of the first friction plates 51 is placed at the foremost position and one of the second friction plates 52 is arranged at the rearmost position in the front-rear direction. The rearmost second friction plate 52 is prevented from further moving rearward by a retaining ring 53 which is fixed on the brake shaft 4 in front of the bearing 561. It is noted that, in the following description, the first friction plates 51 and the second friction plates 52 are collectively referred to as friction plates 50.

The base part 58 is cylindrically shaped and splined-fitted onto an outer periphery of the brake shaft 4 in front of the brake sleeve 55. Thus, the base part 58 is movable in the axial direction of the brake shaft 4 and non-rotatable around the axis. A cylindrical front end portion of the base part 58 is disposed within the recess formed in the dustproof member 43. A cylindrical rear end portion of the base part 58 is loosely fitted in a front end portion of the brake sleeve 55. Further, a central portion of the base part 58 protrudes radially outward in a flange-like shape so as to face the front end portion of the brake sleeve 55. Thus, the base part 58 covers a front opening of the brake sleeve 55 in a non-contact manner. It is noted that a rear opening of the brake sleeve 55 is closed by the bearing 562.

The biasing spring 59 is disposed between a rear end surface of the base part 58 and the foremost first friction plate 51. In the present embodiment, a compression coil spring is employed as the biasing spring 59. The biasing spring 59 is disposed between the base part 58 and the foremost first friction plate 51 in a compressed state and biases the base part 58 and the friction plates 50 away from each other. With such a structure, a front end of the base part 58 pressed forward is held in abutment with the dustproof member 43, so that the base part 58 is prevented from moving forward. Further, the friction plates 50 are pressed rearward by the biasing spring 59 and arranged such that the rearmost second friction plate 52 abuts on the retaining ring 53 while friction surfaces of the first and second friction plates 51, 52 which are adjacent to each other are held in close contact with each other.

By provision of the above-described structure, torque can be transmitted between the first and second friction plates 51, 52 by friction. In other words, the brake shaft 4 and the brake sleeve 55 can transmit torque via the friction surfaces of the friction plates 50. Therefore, when the brake shaft 4 rotates while the brake sleeve 55 is allowed to freely rotate around the rotation axis A2, the brake sleeve 55 also rotates together with the brake shaft 4 by the torque transmitting action caused by frictional engagement (including sliding engagement) between the first and second friction plates 51, 52. On the other hand, when the brake shaft 4 rotates while the brake sleeve 55 is prevented from rotating around the rotation axis A2, a braking force is applied to the brake shaft 4 by the torque transmitting action caused by frictional resistance between the first and second friction plates 51, 52.

In the brake assembly 500, as described above, the friction plates 50 which transmit torque are arranged in close contact with each other and covered by the brake sleeve 55, the base part 58 and the bearing 562. By provision of such a dustproof structure, the friction plates 50 can be protected against foreign matter such as dust from the outside, so that malfunction of the brake mechanism 5 (poor torque transmission of the friction plates 50) can be prevented.

Figure 8:
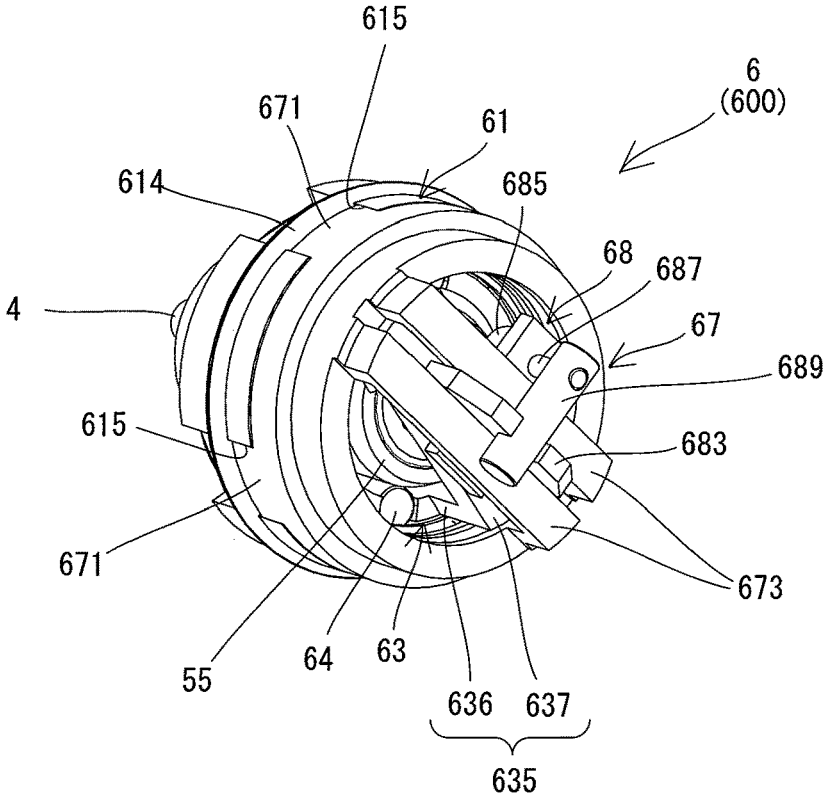
FIG. 8 is a perspective view of the brake assembly and the lock assembly.
Figure 9:
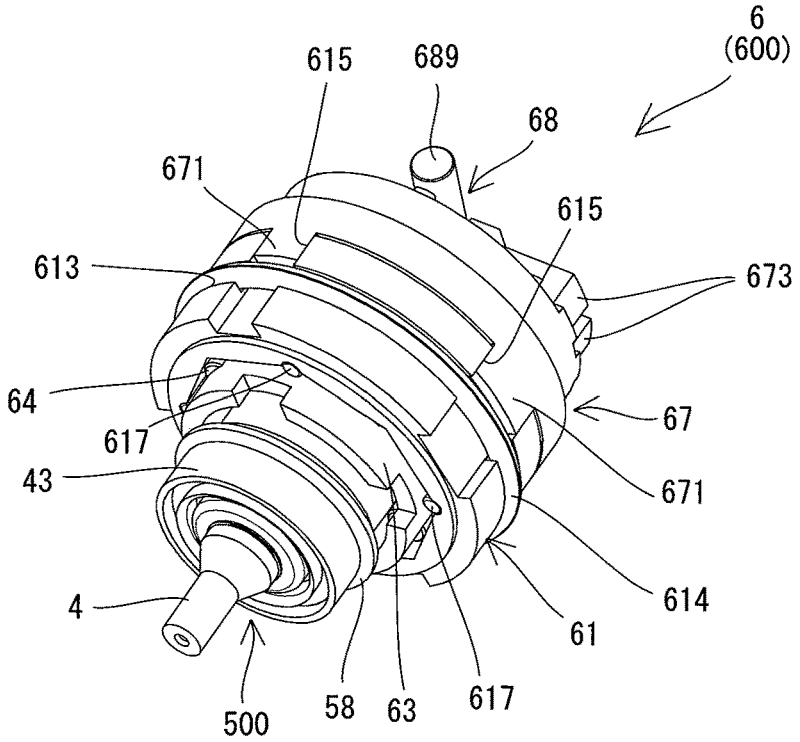
FIG. 9 is another perspective view of the brake assembly and the lock assembly.

The structure of the lock mechanism 6 is now described in detail. The lock mechanism 6 is configured to be switched between a lock state of locking rotation of the brake sleeve 55 around the rotation axis A2 and an unlock state of allowing the rotation, in interlock with movement of the trigger 181. As shown in FIGS. 7 to 9, in the present embodiment, the lock mechanism 6 includes a lock sleeve 61, a retainer 63, lock pins 64, a biasing spring 66, a cover 67 and a slider 68. Further, in the present embodiment, the lock mechanism 6 is configured as a lock assembly 600 by integrally assembling these component members. The component members of the lock mechanism 6 are now described in detail.

Figure 10:
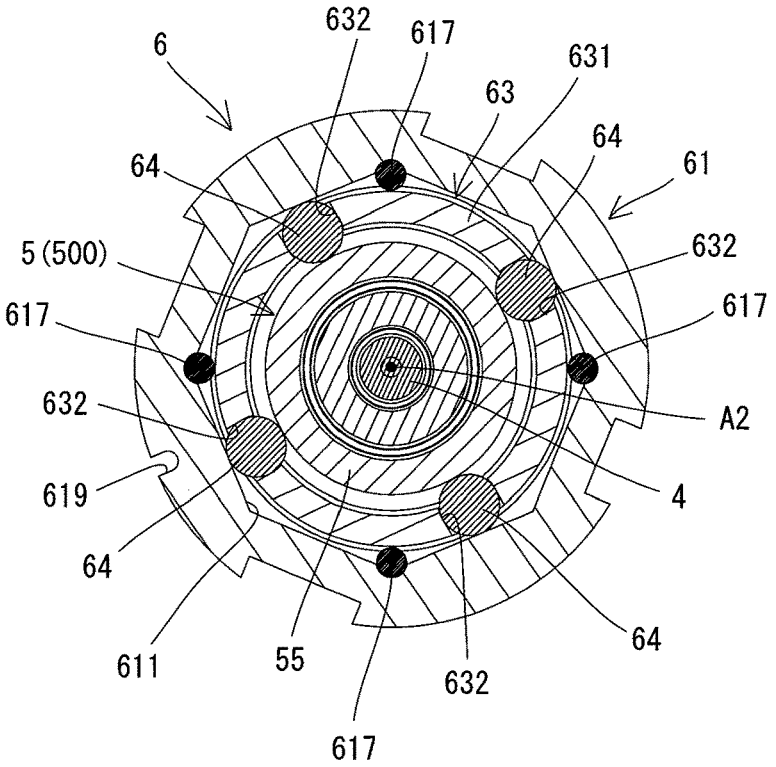
FIG. 10 is a sectional view of a brake mechanism and a lock mechanism when a lock pin is placed in a locked position.

The lock sleeve 61 is now described. As shown in FIGS. 7 to 9, the lock sleeve 61 is configured as a cylindrical member. More specifically, as shown in FIG. 10, an outer periphery of the lock sleeve 61 has a circular cross-section, while an inner periphery of the lock sleeve 61 has a regular octagonal cross-section. Thus, the lock sleeve 61 is configured as a cylindrical member having a through hole 611 having a regular octagonal cross-section. Four columnar rollers 617 are rotatably disposed in every other corners (four of eight corners) of the through hole 611. Each of the rollers 617 is disposed such that its axis extends in parallel to an axis of the lock sleeve 61. As shown in FIGS. 7 to 9, in the outer periphery of the lock sleeve 61, an annular groove 613 is formed to extend around the entire circumference of the lock sleeve 61 in the circumferential direction, and four engagement grooves 615 are formed to linearly extend in the axial direction.

The retainer 63 is now described. The retainer 63 is a cylindrical member configured to retain the lock pins 64. As shown in FIG. 7, the retainer 63 includes a pin-retaining part 631 and an actuation part 635 which are integrally formed with each other.

As shown in FIG. 10, the pin-retaining part 631 is a cylindrical portion which is inserted through the through hole 611 of the lock sleeve 61. Therefore, the outer diameter of the pin-retaining part 631 is set to be slightly smaller than the minimum diameter (that is, the distance between opposite sides of the octagon) of the through hole 611 of the lock sleeve 61. Further, the pin-retaining part 631 is arranged on an outer periphery side of the brake assembly 500 (specifically, the brake sleeve 55). Therefore, the inner diameter of the pin-retaining part 631 is set to be larger than the outer diameter of the brake sleeve 55. Further, the length of the pin-retaining part 631 in the axial direction (front-rear direction) is set to be longer than that of the lock sleeve 61. The pin-retaining part 631 is held to be rotatable around the rotation axis A2 within the through hole 611, by the rollers 617 which are disposed in the four corners of the through hole 611 of the lock sleeve 61.

As shown in FIGS. 7 and 10, a plurality of recesses 632 for retaining the lock pins 64 are formed in the pin-retaining part 631. In the present embodiment, four recesses 632 are provided at equal intervals in the circumferential direction. Each recess 632 linearly extends forward from a rear end of the pin-retaining part 631 (specifically, cylindrical wall portion). Each of the lock pins 64 has a columnar shape and is rotatably disposed within the recess 632 such that its axis extends in parallel to an axis of the retainer 63. The length of the recess 632 in the axial direction substantially corresponds to the length of the lock pin 64. Further, the width of the recess 632 in the circumferential direction substantially corresponds to the diameter of the lock pin 64. Further, as shown in FIG. 10, the recess 632 has a generally rectangular section, but only an end portion on the inner peripheral side of the recess 632 has a slightly reduced width in the circumferential direction. With such a structure, the lock pin 64 is prevented from moving inward in the radial direction from a specified position.

As shown in FIG. 10, the pin-retaining part 631 is inserted through the through hole 611 with the lock pins 64 disposed within the recesses 632. Each recess 632 (i.e. each lock pin 64) is arranged between two adjacent ones of the rollers 617 which are disposed in the corners of the through hole 611. The diameter of the lock pin 64 is set to be larger than the thickness of the wall portion of the pin-retaining part 631. Further, the diameter of the lock pin 64 is smaller than a difference between the maximum radius of the through hole 611 (that is, half a distance between two opposite corners of the octagon) and the radius of the brake sleeve 55. Moreover, the diameter of the lock pin 64 is larger than a difference between the minimum radius of the through hole 611 (that is, half the distance between opposite sides of the octagon) and the radius of the brake sleeve 55.

As shown in FIGS. 6 and 7, the actuation part 635 includes two arm parts 636 which protrude rearward from a rear end of the pin-retaining part 631 and a rectangular plate-like abutment part 637 which connects protruding ends (rear end portions) of the arm parts 636. The arm part 636 protrudes rearward from the lock sleeve 61 when the retainer 63 is disposed in the through hole 611. The abutment part 637 linearly extends along a diameter of the retainer 63 through the axis of the retainer 63 and has a through hole 638 in its center.

Figure 11:
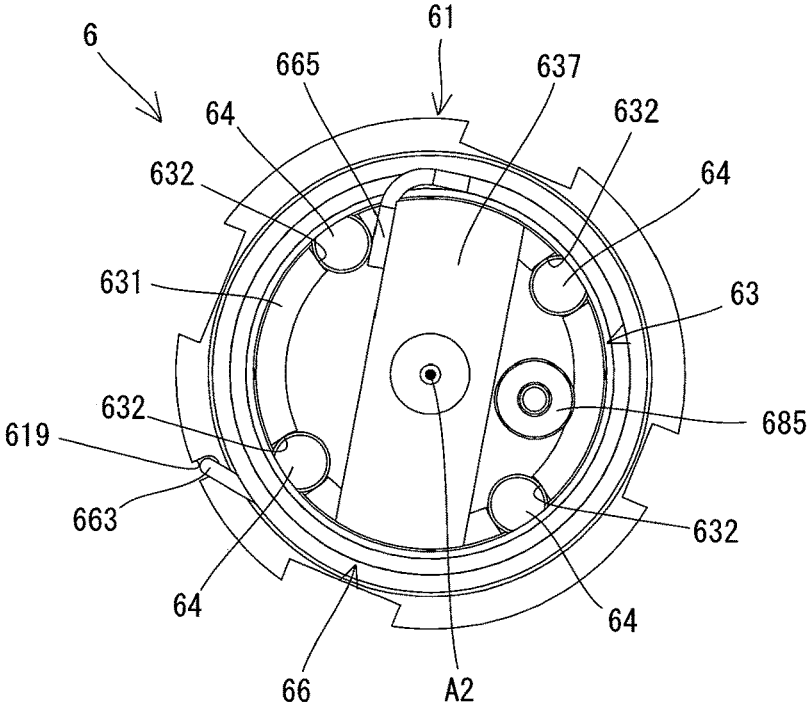
FIG. 11 is an explanatory drawing for illustrating the arrangement relation among a retainer, a biasing spring and an abutment pin when a trigger is in an OFF position and the lock pin is placed in the locked position.

The biasing spring 66 is an elastic member configured to bias the retainer 63 in a specified rotation direction relative to the lock sleeve 61. In the present embodiment, a torsion coil spring is employed as the biasing spring 66. As shown in FIGS. 6 and 7, the biasing spring 66 is fitted on the actuation part 635 (specifically, the arm part 636) of the retainer 63. A front end position of the biasing spring 66 is defined by a retaining ring 669 disposed on the rear side of the lock sleeve 61. As shown in FIGS. 7 and 11, one end portion of the biasing spring 66 which functions as a fixed end part 663 is locked to a locking groove 619 formed in an outer periphery of the lock sleeve 61 and fixed to the lock sleeve 61. The other end portion of the biasing spring 66 which functions as an actuation end part 665 is locked to one side surface of the abutment part 637. The retainer 63 is normally biased in a clockwise direction in the rear view (a clockwise direction in FIG. 11) by an elastic force of the biasing spring 66 and held in a locked position, which will be described later, together with the lock pins 64.

The cover 67 is non-rotatably connected to the lock sleeve 61 and covers the retainer 63 which is held in the lock sleeve 61. Further, the cover 67 is configured as a guide member for guiding the slider 68, which will be described later, to slide in a specified direction. As shown in FIG. 7, the cover 67 has a cylindrical shape as a whole, including a front portion having a larger diameter and a rear portion having a smaller diameter. Four engagement projections 671 are formed on a front end of the cover 67 and protrude forward. The engagement projections 671 are configured to be engaged with the engagement grooves 615 of the lock sleeve 61. Further, a pair of guide parts 673 are provided on a rear end of the cover 67 and linearly extend in parallel to a diameter of the cover 67.

The slider 68 is configured as an interlocking member which is connected to the trigger 181 and moves in interlock with movement of the trigger 181 to thereby rotate the retainer 63 around the rotation axis A2. More specifically, the slider 68 is configured to linearly move in the specified direction in abutment with the abutment part 637 of the retainer 63 in interlock with movement of the trigger 181 and thereby rotate the retainer 63 around the rotation axis A2. As shown in FIG. 7, in the present embodiment, the slider 68 includes a base part 681, an engagement part 683, an abutment pin 685, a support pin 687 and a connection pin 689.

As shown in FIG. 7, the base part 681 has a rectangular plate-like shape and is arranged to cross the abutment part 637 in abutment with a rear surface of the abutment part 637. The engagement part 683 is provided to protrude rearward from the base part 681. The engagement part 683 has a plate-like shape and has a thickness substantially equal to a distance between the guide parts 673 of the cover 67. Further, the engagement part 683 is slidably disposed in a gap between the guide parts 673, and therefore has a shorter length than the guide part 673. A columnar abutment pin 685 protrudes forward from a front surface of the base part 681. Further, the abutment pin 685 is positioned on the side of a side surface (on a biasing direction side) opposite to the side surface of the abutment part 637 on which the actuation end part 665 of the biasing spring 66 abuts. A columnar support pin 687 protrudes rearward from the base part 681.

The above-described components of the slider 68 other than the connection pin 689 are arranged on the rear side of the abutment part 637 of the retainer 63, and then the cover 67 is connected to the lock sleeve 61. Specifically, the engagement part 683 of the slider 68 is inserted through the gap between the guide parts 673 of the cover 67, and then the engagement projections 671 of the cover 67 are engaged with portions of the engagement grooves 615 of the lock sleeve 61 which extend rearward of the annular groove 613 (see FIG. 9). As a result, the cover 67 is non-rotatably connected to the lock sleeve 61. As shown in FIGS. 5 and 8, when the cover 67 is connected to the lock sleeve 61, a rear end portion of the engagement part 683 protrudes rearward from the guide parts 673. The support pin 687 protrudes adjacent to the guide part 673 and rearward of the guide part 673. Further, a semicircular recess is formed in the rear end portion of the engagement part 683.

As shown in FIGS. 5 and 8, one end portion of the connection pin 689 is fitted in the semicircular recess of the engagement part 683 and a rear end portion of the support pin 687 is fitted into a fitting hole formed in the other end portion of the connection pin 689, so that the connection pin 689 is connected to the engagement part 683 and the support pin 687. It is noted that the connection pin 689 is disposed behind the guide parts 673 of the cover 67 so as to extend orthogonally to the guide parts 673. By provision of the above-described structure, the slider 68 is held by the cover 67 so as to be slidable in the extending direction of the guide parts 673.

As shown in FIGS. 4 and 5, a cylindrical lock-mechanism-holding part 131 is provided within the brake housing 13. The lock assembly 600 having the above-described structure is fitted into the lock-mechanism-holding part 131 with an O-ring 614 mounted in the annular groove 613 (see FIG. 7) of the lock sleeve 61. At this time, the lock assembly 600 is arranged such that the guide parts 673 of the cover 67 extend in the up-down direction (in other words, such that a moving path of the slider 68 extends in the up-down direction). Further, a fixed ring 675 is disposed on a rear surface of the larger-diameter part of the cover 67 and fixed to a rear end of the lock-mechanism-holding part 131 with screws 679 (see FIG. 5). Thus, the lock assembly 600 is held by the brake housing 13 in a state that resistance is imparted to the lock assembly 600 against movement in the front-rear direction and rotation around the rotation axis A2 while being allowed to slightly move in the radial direction by elastic deformation of the O-ring 614. Further, although not shown in detail, portions of the engagement grooves 615 which extend forward of the annular groove 613 (see FIG. 9) are loosely fitted onto protrusions formed on the lock-mechanism-holding part 131, so that rotation of the lock sleeve 61 around the rotation axis A2 relative to the housing 10 is restricted (limited).

It is noted that, in the present embodiment, the brake housing 13 is separately formed from the motor housing 12 and the handle housing 16. Therefore, the brake housing 13 to which the lock assembly 600 is fixed can be easily assembled to the motor housing 12 and the handle housing 16.

In this manner, the lock mechanism 6 is held by the brake housing 13 via the lock sleeve 61. Thus, the brake mechanism 5, the retainer 63 and the lock sleeve 61 are coaxially disposed. More specifically, the retainer 63 is disposed radially outside the brake sleeve 55. Further, the rear end portion of the brake shaft 4 protrudes rearward of the brake sleeve 55 and is loosely fitted in the through hole 638 of the abutment part 637. Moreover, the lock sleeve 61 is disposed radially outside the retainer 63.

Figure 12:
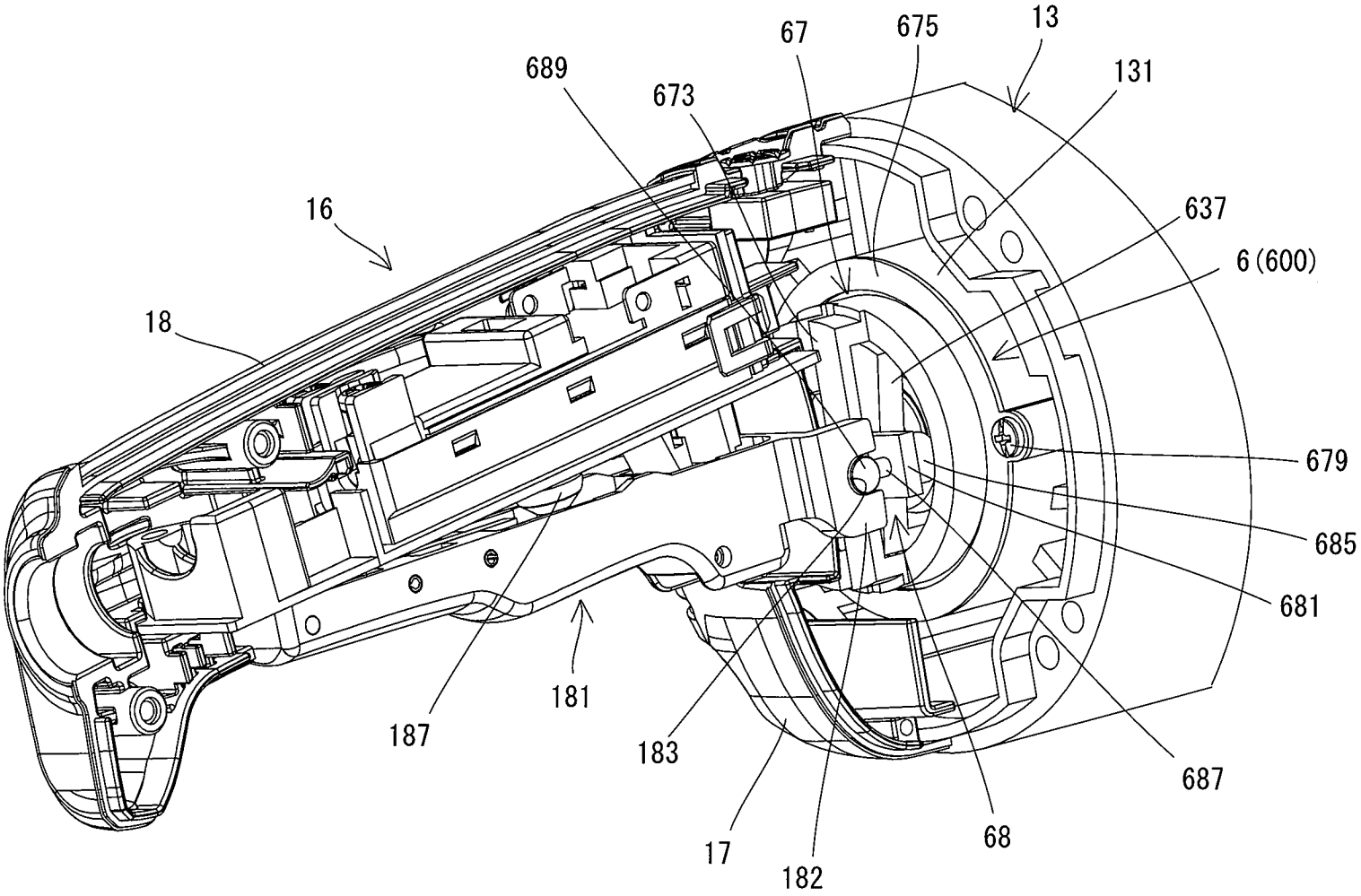
FIG. 12 is an explanatory drawing for illustrating the arrangement relation among the trigger, a slider and an abutment part when the trigger is in the OFF position.

Further, the trigger 181 is connected to the connection pin 689 of the lock mechanism 6 (the slider 68). More specifically, as shown in FIGS. 5 and 12, an engagement arm 182 is formed on a right front end portion of the trigger 181 and protrudes forward. A semicircular engagement recess 183 is formed in a front end portion of the engagement arm 182. A right end portion of the connection pin 689 is rotatably engaged with the engagement recess 183, so that the connection pin 689 is connected to the trigger 181.

The correlation among the brake mechanism 5, the lock mechanism 6 and the trigger 181 is now described.

As described above, in the present embodiment, as shown in FIG. 11, the retainer 63 is normally biased in a clockwise direction in the rear view (a clockwise direction in FIG. 11) by the elastic force of the biasing spring 66 and held in the locked position shown in FIG. 10 together with the lock pins 64. The locked position is a position where the lock pins 64 retained in the respective recesses 632 of the retainer 63 are held between the inner periphery of the lock sleeve 61 and an outer periphery of the brake sleeve 55.

In the present embodiment, the through hole 611 of the lock sleeve 61 has an octagonal cross-section and the brake sleeve 55 has a cylindrical shape. Therefore, the distance between the inner periphery of the lock sleeve 61 and the outer periphery of the brake sleeve 55 in the radial direction is not uniform. Particularly, as shown in FIG. 10, a space corresponding to a region from one corner of the octagon to a center point of one side of the octagon between the lock sleeve 61 and the brake sleeve 55 is formed as a wedge-like space in which this distance between the lock sleeve 61 and the brake sleeve 55 gradually decreases toward the center point of the side from the corner. The lock pins 64 are each disposed in this wedge-like space and biased in a direction in which the wedge-like space is gradually narrowed in the circumferential direction. Further, as described above, the diameter of the lock pin 64 is set to be larger than the difference between the minimum radius of the through hole 611 and the radius of the brake sleeve 55.

Therefore, the lock pins 64 are each held between the inner periphery of the lock sleeve 61 and the outer periphery of the brake sleeve 55 at a specified position within the wedge-like space. Therefore, even if the brake sleeve 55 tends to rotate in the clockwise direction in the rear view (the clockwise direction in FIG. 10), the brake sleeve 55 is integrated with the lock sleeve 61 via the lock pins 64 by a wedge effect of the lock pins 64 and thus cannot rotate. In other words, the brake sleeve 55 is non-rotatably locked.

When the retainer 63 and the lock pins 64 are placed in the locked position, as shown in FIGS. 11 and 12, the abutment part 637 is held in a tilted position in which the abutment part 637 is tilted rightward relative to the up-down direction (that is, the extending direction of the guide parts 673 and the moving path of the slider 68). Further, the trigger 181 is held in a lowermost position (OFF position) in an initial state in which the trigger 181 is not yet depressed. Therefore, the slider 68 connected to the trigger 181 via the connection pin 689 is placed in a lowermost position on the moving path. At this time, the abutment pin 685 of the slider 68 which is arranged on the right side of the abutment part 637 is positioned so as not to interfere with the abutment part 637. In the present embodiment, when the slider 68 is placed in the lowermost position, as shown in FIG. 11, a left end of the abutment pin 685 is located below the rotation axis A2 of the retainer 63 in the up-down direction. As described above, in the present embodiment, when the trigger 181 is in the OFF position, the retainer 63 and the lock pins 64 are in the locked position and the lock mechanism 6 non-rotatably locks the brake sleeve 55.

Figure 13:
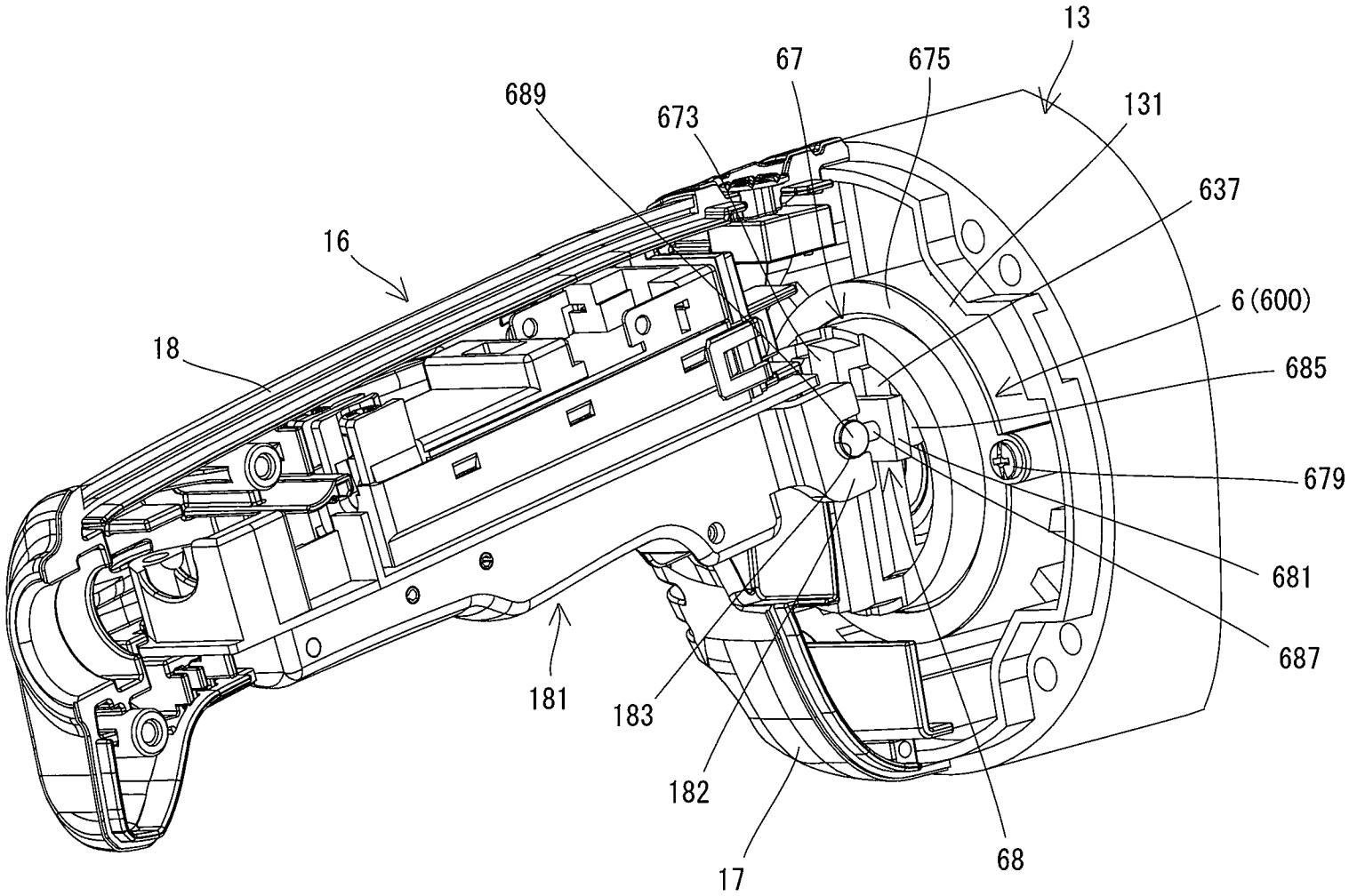
FIG. 13 is an explanatory drawing for illustrating the arrangement relation among the trigger, the slider and the abutment part when the trigger is in an ON position.
Figure 14:
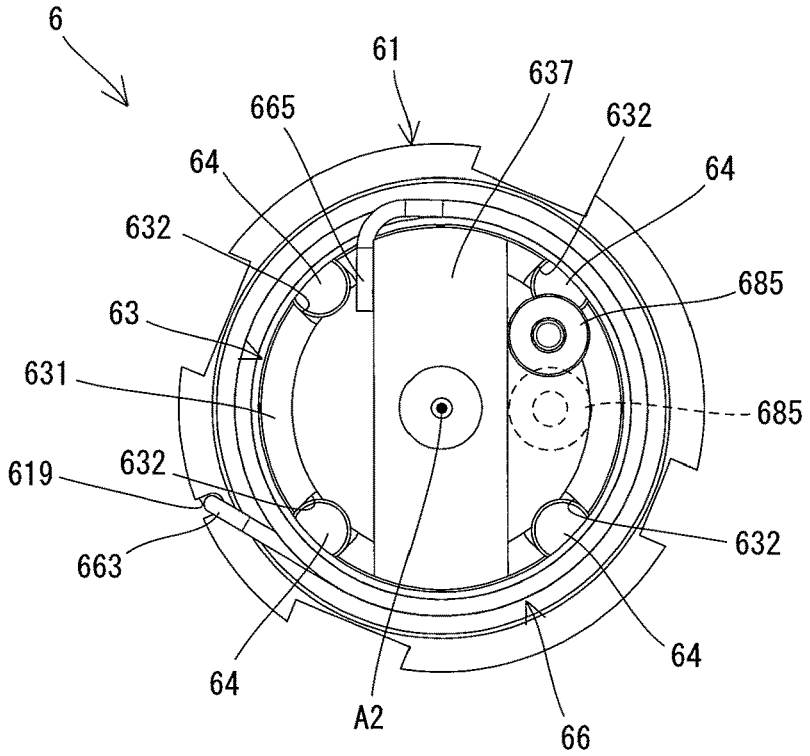
FIG. 14 is an explanatory drawing for illustrating the arrangement relation among the retainer, the biasing spring and the abutment pin when the trigger is in a switching position and the ON position and the lock pin is in an unlocked position.
Figure 15:
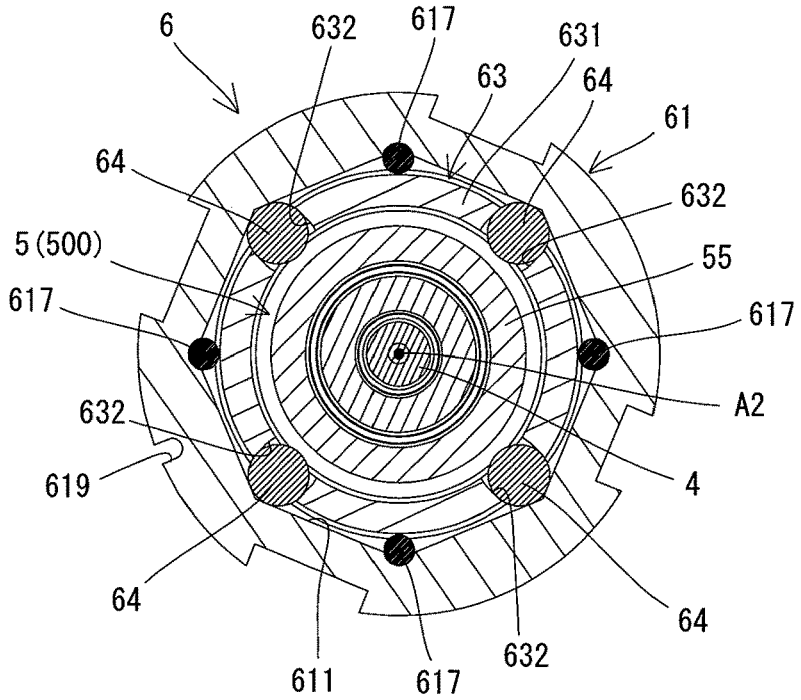
FIG. 15 is a sectional view of the brake mechanism and the lock mechanism when the lock pin is in the unlocked position.

As shown in FIG. 13, when the trigger 181 is depressed and turned upward from the OFF position to the ON position, the slider 68 moves upward from the lowermost position in interlock with the trigger 181. Accordingly, as shown in FIG. 14, the abutment pin 685 moves upward in abutment with the right side surface of the abutment part 637 of the retainer 63 and turns the retainer 63 counterclockwise via the abutment part 637 against the biasing force of the biasing spring 66. It is noted that, in the present embodiment, the abutment part 637 is positioned to extend in the up-down direction when the abutment pin 685 reaches a position (shown by a dotted line in FIG. 14) where the abutment pin 685 abuts on the abutment part 637 at the same position as the rotation axis A2 of the abutment part 637 (the retainer 63) in the up-down direction. As shown in FIG. 15, each of the lock pins 64 retained by the retainer 63 moves, along with movement of the abutment pin 685, in a direction (a counterclockwise direction in FIG. 15) in which the wedge-like space is gradually widened in the circumferential direction, and is placed in the corner of the through hole 611.

As described above, the diameter of the lock pin 64 is set to be smaller than the difference between the maximum radius (that is, half the distance between two opposed corners of the octagon) of the through hole 611 and the radius of the brake sleeve 55. Therefore, the lock pin 64 is loosely disposed between the inner periphery of the lock sleeve 61 and the brake sleeve 55 in the corner. Thus, lock of the brake sleeve 55 is released and the brake sleeve 55 is allowed to rotate. Therefore, the positions of the retainer 63 and the lock pins 64 in which the lock pins 64 are placed in the corners are referred to as an unlocked position.

In the present embodiment, the position of the trigger 181 in which the trigger 181 places the retainer 63 and the lock pins 64 in the unlocked position (that is, when the abutment pin 685 abuts on the abutment part 637 at the same position as the rotation axis A2 in the up-down direction, as shown by the dotted line in FIG. 14) is below the ON position. To put it differently, the lock mechanism 6 is configured to be switched from the lock state of non-rotatably locking the brake sleeve 55 to the unlock state of allowing the brake sleeve 55 to rotate, before the trigger 181 reaches the ON position from the OFF position (in other words, before the switch 187 is turned on and driving of the motor 2 is started). It is noted that the position of the trigger 181 in which the lock mechanism 6 is switched between the lock state and the unlock state is hereinafter referred to as a switching position.

Even if the trigger 181 is further turned upward from the switching position by user's depressing operation and the abutment pin 685 is further moved upward in abutment with the right side surface of the abutment part 637, the abutment part 637 is not further turned counterclockwise, but held in a state of extending in the up-down direction. Therefore, a user can move the trigger 181 to the ON position simply by depressing the trigger 181 with a relatively small force. Meanwhile, the retainer 63 and the lock pins 64 are held in the unlocked position and the brake sleeve 55 is allowed to rotate.

When the trigger 181 is turned to the ON position, the switch 187 is switched to the ON state and driving of the motor 2 is started. Thus, the motor shaft 25 rotates in the clockwise direction in the rear view. Rotation of the motor shaft 25 is transmitted to the spindle 30 and the tool accessory 9 mounted to the tool-mounting part 31 is rotationally driven. Further, the brake shaft 4 integrated with the motor shaft 25 also rotates together with the tool-mounting part 31. At this time, the lock mechanism 6 is in the unlock state and the brake sleeve 55 is allowed to rotate around the rotation axis A2. Therefore, the brake sleeve 55 also rotates together with the brake shaft 4 by the torque transmitting action caused by frictional engagement between the first and second friction plates 51, 52. The frictional engagement here refers to engagement by frictional force, which may include sliding engagement.

When the user releases the operation of depressing the trigger 181, the switch 187 is switched to the OFF state and driving of (energization to) the motor 2 is stopped. In the grinder 1, even if driving of the motor 2 is stopped, the spindle 30, the motor shaft 25 and the brake shaft 4 continue to rotate by inertial force (particularly, inertial force of the tool accessory 9) without stopping immediately. Meanwhile, the trigger 181 turns downward to the OFF position, and in interlock with this movement, the slider 68 also moves downward while being guided to slide by the guide parts 673. When the trigger 181 is moved downward to below the switching position, holding of the abutment part 637 by the abutment pin 685 is released, and the retainer 63 and the lock pins 64 are moved from the unlocked position to the locked position in the clockwise direction in the rear view by the elastic force of the biasing spring 66. At this time, since the brake shaft 4 rotates in the clockwise direction in the rear view, the lock pin 64 is immediately moved to the locked position by rotation of the brake sleeve 55 and non-rotatably locks the brake sleeve 55.

When the brake sleeve 55 is locked and stops rotation, a braking force is applied to the brake shaft 4 which continues to rotate, by the torque transmitting action caused by frictional resistance between the first and second friction plates 51, 52. Thus, the brake shaft 4 decelerates and stops rotating. The motor shaft 25 which rotates together with the brake shaft 4 and the tool-mounting part 31 which is rotated by the motor shaft 25 also stop rotating. Thus, rotational driving of the tool accessory 9 is stopped. It is noted that, in the present embodiment, the brake mechanism 5 is configured to stop rotation of the brake shaft 4 in about three seconds after the lock mechanism 6 is locked (that is, after the brake mechanism 5 starts applying the braking force to the brake shaft 4).

As described above, in the grinder 1 of the present embodiment, the lock mechanism 6 and the brake mechanism 5 are sequentially actuated in interlock with the operation of turning the trigger 181 to the OFF position, so that the tool accessory 9 mounted to the tool-mounting part 31 can be prevented from continuing to rotate by inertia after driving of the motor 2 is stopped.

In the present embodiment, the lock mechanism 6 includes the lock sleeve 61 which is disposed radially outside of the brake sleeve 55 such that its rotation around the rotation axis A2 is restricted, and the lock pins 64 which are retained to be movable in the circumferential direction between the lock sleeve 61 and the brake sleeve 55. The lock pins 64 each moves from the unlocked position to the locked position in the circumferential direction in interlock with movement of the trigger 181 from the ON position to the OFF position, and thereby switches the brake sleeve 55 from a rotation-allowed state to a rotation-disabled state. Further, the lock pins 64 are each configured to be held between the lock sleeve 61 and the brake sleeve 55 in the locked position to thereby non-rotatably lock the brake sleeve 55. With such a structure, only a relatively small force may be required to move the lock pins 64 in the circumferential direction, and in addition, rotation of the brake sleeve 55 can be immediately stopped so that a braking force can be applied to the brake shaft 4. Further, the lock pins 64 each exhibits a wedge effect by slight movement in the circumferential direction and thereby can reliably lock the brake sleeve 55. Compared with a mechanism in which the lock pins 64 move in the rotation-axis-A1 direction or the radial direction, the lock mechanism 6 can be formed compact.

Further, torque is transmitted between the brake sleeve 55 and the brake shaft 4 via the friction plates 50. Therefore, after the brake sleeve 55 is locked, the brake shaft 4 and the tool-mounting part 31 would not be suddenly stopped but can be gradually decelerated and stopped. In use of the tool accessory 9 having a large mass, if the tool accessory 9 suddenly stops rotating, a screw of the lower flange of the tool-mounting part 31 may be loosened to cause loosening of the fixed tool accessory 9, or parts on a power transmission path from the motor 2 to the tool accessory 9 may be broken by impact, or the grinder 1 may be swayed by reaction. As a countermeasure, specified time required to stop can be properly set by setting load on the biasing spring 59 or by selecting, for example, materials of the friction surfaces of the first and second friction plates 51, 52. Particularly, in the present embodiment, the brake mechanism 5 is configured as a multi-plate frictional brake mechanism. Therefore, compared with a case in which a single-plate brake mechanism is adopted, a stress to be applied to each friction plate 50 can be reduced, so that the life of each friction plate 50 can be extended. Further, the friction plates 50 can transmit relatively large torque for the size in the radial direction.

In the present embodiment, the lock mechanism 6 is configured to be switched from the lock state to the unlock state before the trigger 181 reaches the ON position from the OFF position (specifically, when the trigger 181 is moved to the switching position). With such a structure, driving of the motor 2 can be started after the brake sleeve 55 is allowed to rotate together with the brake shaft 4, that is, after the brake shaft 4 is turned to a state that the braking force is not applied thereto. Therefore, the brake shaft 4 and thus the tool-mounting part 31 can be smoothly rotated from the start of driving of the motor 2.

In the present embodiment, it can also be said that the lock mechanism 6 and the brake mechanism 5 function as two brake mechanisms which operate in series, and form a braking system, as a whole, which is configured to apply a braking force to the brake shaft 4. Specifically, the lock mechanism 6 can be regarded as a first brake mechanism which is configured to actuate the brake mechanism 5 in interlock with movement of the trigger 181 from the ON position to the OFF position. Further, the brake mechanism 5 can be regarded as a second brake mechanism which is configured to be actuated by the lock mechanism 6 to apply a braking force to the brake shaft 4. In the present embodiment, by appropriately setting the operation of the lock mechanism 6 which interlocks with the trigger 181 and the operation of the brake mechanism 5 which brakes the brake shaft 4, operability of the trigger 181 can be improved and the brake shaft 4 can be stopped at an appropriate timing.

The above-described embodiment is a mere example and the work tool according to the present invention is not limited to the structure of the grinder 1 of the above-described embodiment. For example, the following modifications may be made. Further, one or more of these modifications may be employed independently or in combination with the grinder 1 of the above-described embodiment or the claimed invention.

For example, in the above-described embodiment, the brake mechanism 5 is configured to brake the brake shaft 4 connected to the rear end portion of the motor shaft 25. The brake mechanism 5 may, however, be configured to stop rotation of the tool accessory 9 by braking another shaft which rotates together with the tool-mounting part 31 to which the tool accessory 9 is mounted, when the trigger 181 is placed in the OFF position. For example, the brake mechanism 5 may be provided to brake the spindle 30 having the tool-mounting part 31. Further, for example, in a case where the grinder 1 includes an intermediate shaft which is configured to transmit rotating power from the motor shaft 25 to the spindle 30, the brake mechanism 5 may be provided to brake the intermediate shaft.

The brake mechanism 5 is configured as a multi-plate frictional brake mechanism, but a single-plate frictional brake mechanism may be adopted. Further, in place of the frictional brake mechanism, a fluid type brake mechanism which utilizes fluid (such as oil), or an electromagnetic brake mechanism or a permanent magnet-type brake mechanism each of which utilizes a magnetic field may be adopted to transmit torque between the brake shaft 4 and the brake sleeve 55.

The structure of the lock mechanism 6 may be appropriately changed, as long as the lock mechanism 6 can be switched between the lock state and the unlock state in interlock with movement of the trigger 181. It is noted that the lock state here refers to a state in which the lock mechanism 6 locks a rotating member (the brake sleeve 55 in the above-described embodiment) which is capable of transmitting torque to and from the brake shaft 4 while the rotating member is allowed to rotate relative to the brake shaft 4. The unlock state here refers to a state in which the lock mechanism 6 allows rotation of the rotating member. For example, the lock sleeve 61 and the brake sleeve 55 may be configured such that the lock sleeve 61 has a through hole having a circular cross-section, while the outer periphery of the brake sleeve 55 has a polygonal cross-section, or they may be shaped otherwise. Further, the number of the lock pins 64, the shape of the retainer 63 and the structure of connecting the retainer 63 and the trigger 181 may be appropriately changed.

Correspondences between the features of the above-described embodiment and the modifications thereof and the features of the invention are as follows.

The grinder 1 is an example that corresponds to the "work tool" according to the present invention. The motor 2 is an example that corresponds to the "motor" according to the present invention. The tool-mounting part 31 is an example that corresponds to the "tool-mounting part" according to the present invention. The brake shaft 4 is an example that corresponds to the "rotary shaft" according to the present invention. The brake sleeve 55 is an example that corresponds to the "rotating member" according to the present invention. The switch 187 is an example that corresponds to the "switch" according to the present invention. The trigger 181 is an example that corresponds to the "operation member" according to the present invention. The ON position and the OFF position of the trigger 181 are examples that correspond to the "ON position" and the "OFF position", respectively, according to the present invention. The lock mechanism 6 is an example that corresponds to the "lock mechanism" according to the present invention.

The lock sleeve 61 is an example that corresponds to the "cylindrical member" according to the present invention. The lock pin 64 is an example that corresponds to the "engagement member" according to the present invention. The locked position and the unlocked position of the lock pin 64 are examples that correspond to the "engaged position" and the "disengaged position", respectively, according to the present invention. The retainer 63 is an example that corresponds to the "retaining member" according to the present invention. The biasing spring 66 is an example that corresponds to the "first biasing member" according to the present invention. The clockwise direction and the counterclockwise direction in FIG. 11 are examples that correspond to the "first rotation direction" and the "second rotation direction", respectively, according to the present invention. The locked position and the unlocked position of the retainer 63 are examples that correspond to the "first retaining position" and the "second retaining position", respectively, according to the present invention. The first friction plate 51 and the second friction plate 52 are examples that correspond to the "first frictional-engagement part" and the "second frictional-engagement part", respectively, according to the present invention. The biasing spring 59 is an example that corresponds to the "second biasing member" according to the present invention. The stator 21, the rotor 23 and the motor shaft 25 are examples that correspond to the "stator", the "rotor" and the "motor shaft", respectively, according to the present invention. The tapered part 402 is an example that corresponds to the "tapered part" according to the present invention. The tapered hole 256 is an example that corresponds to the "tapered hole" according to the present invention. The motor housing 12 and the opening 124 are examples that correspond to the "motor housing" and the "opening", respectively, according to the present invention. The dustproof member 43 is an example that corresponds to the "dustproof member" according to the present invention.

The lock mechanism 6 and the brake mechanism 5 altogether are an example that correspond to the "brake system" according to the present invention. The lock mechanism 6 is an example that corresponds to the "first brake mechanism" according to the present invention. The brake mechanism 5 is an example that corresponds to the "second brake mechanism" according to the present invention. The friction plates 50 (the first and second friction plates 51, 52) are an example that corresponds to the "torque transmission part" according to the present invention.

In view of the nature of the present invention, the above-described embodiment and its modifications, the following features can be provided. Each of the features can be employed in combination with any of the grinder 1 of the above-described embodiment, the above-described modifications and the claimed invention.

(Aspect 1)

The lock mechanism may further include a retaining member which is configured to retain the engagement member, the retaining member may be connected to the operation member and may be disposed radially outside of the rotating member and radially inside of the cylindrical member so as to be rotatable around the rotation axis within a specified rotation range, and the retaining member may be configured to move the engagement member between the engaged position and the disengaged position in the circumferential direction by rotating around the rotation axis in interlock with movement of the operation member.

It is noted that the retaining member may be connected to the operation member directly or via an intervening member. The retainer 63 is an example that corresponds to the "retaining member" in the present aspect.

(Aspect 2)

The lock mechanism may further include a first biasing member which is configured to bias the retaining member in a first rotation direction, and the retaining member may be configured to:

place the engagement member in the engaged position by being rotated to a first retaining position in the first rotation direction by a biasing force of the first biasing member in interlock with movement of the operation member from the ON position to the OFF position, and place the engagement member in the disengaged position by being rotated to a second retaining position in a second rotation direction opposite to the first rotation direction against the biasing force in interlock with movement of the operation member from the OFF position to the ON position.

It is noted that the biasing spring 66 is an example that corresponds to the "first biasing member" in the present aspect. The clockwise direction and the counterclockwise direction in FIG. 11 are examples that correspond to the "first rotation direction" and the "second rotation direction", respectively, in the present aspect. The locked position and the unlocked position of the retainer 63 are examples that correspond to the "first retaining position" and the "second retaining position", respectively, in the present aspect.

(Aspect 3)

The engagement member may be configured to non-rotatably lock the rotating member by a wedge effect when placed in the engaged position.

(Aspect 4)

The first frictional-engagement part and the second frictional-engagement part may be arranged side by side in the rotation axis direction, the work tool may further include a second biasing member which is configured to bias at least one of the first frictional-engagement part and the second frictional-engagement part in a direction to bring the friction surface of first frictional-engagement part and the friction surface of the second frictional-engagement part into contact with each other, and the friction surface of first frictional-engagement part and the friction surface of the second frictional-engagement part may be normally held in contact with each other by a biasing force of the second biasing member.

It is noted that the biasing spring 59 is an example that corresponds to the "second biasing member" in the present aspect.

(Aspect 5)

The second brake mechanism may comprise a frictional brake mechanism including a first frictional-engagement part which is disposed to rotate together with the rotary shaft and a second frictional-engagement part which is disposed to be normally held in contact with the first frictional-engagement part, the first brake mechanism may be configured as a lock mechanism including an engagement member which is engageable with the second frictional-engagement part, the engagement member may be configured to stop rotation of the second frictional-engagement part which rotates together with the first frictional-engagement part in frictional engagement with the first frictional-engagement part by engaging with the second frictional-engagement part in interlock with movement of the operation member from the ON position to the OFF position, and the second frictional-engagement part may be configured to apply the braking force to the rotary shaft via the first frictional-engagement part when the engagement member stops rotation of the second frictional-engagement part.

It is noted that the first friction plate 51 and the second friction plate 52 are examples that correspond to the "first frictional-engagement part" and the "second frictional-engagement part", respectively, in the present aspect. The lock pin 64 is an example that corresponds to the "engagement member" in the present aspect.

DESCRIPTION OF THE NUMERALS

1: grinder, 10: housing, 11: gear housing, 110: outlet, 12: motor housing, 123: bearing holding part, 124: opening, 125: projection, 13: brake housing, 131: lock mechanism holding part, 16: handle housing, 17: rear cover part, 170: inlet, 18: grip part, 181: trigger, 182: engagement arm, 183: engagement recess, 187: switch, 188: pin, 2: motor, 21: stator, 23: rotor, 25: motor shaft, 251: bearing, 253: bearing, 255: connection hole, 256: tapered hole, 257: threaded hole, 27: fan, 28: dustproof member, 3: driving mechanism, 30: spindle, 301: bearing, 303: bearing, 31: tool-mounting part, 33: small bevel gear, 35: large bevel gear, 4: brake shaft, 401: male thread part, 402: tapered part, 405: spline teeth, 431: magnet, 43: dustproof member, 45: rotation position sensor, 5: brake mechanism, 500: brake assembly, 50: friction plate, 51: first friction plate, 52: second friction plate, 53: retaining ring, 55: brake sleeve, 555: spline teeth, 561: bearing, 562: bearing, 58: base part, 59: biasing spring, 6: lock mechanism, 600: lock assembly, 61: lock sleeve, 611: through hole, 613: annular groove, 614: O-ring, 615: engagement groove, 617: roller, 619: locking groove, 63: retainer, 631: pin-retaining part, 632: recess, 635: actuation part, 636: arm part, 637: abutment part, 638: through hole, 64: lock pin, 66: biasing spring, 663: fixed end part, 665: actuation end part, 669: retaining ring, 67: cover, 671: engagement projection, 673: guide part, 675: fixed ring, 679: screw, 68: slider, 681: base part, 683: engagement part, 685: abutment pin, 687: support pin, 689: connection pin, 8: controller, 9: tool accessory, 90: wheel cover, A1: rotation axis, A2: rotation axis

The invention claimed is:

1. A work tool configured to rotationally drive a tool accessory, the work tool comprising:

a motor;

a tool-mounting part configured to removably receive the tool accessory and to rotate by power of the motor;

a rotary shaft configured to rotate around a rotation axis with the tool-mounting part by the power of the motor;

a rotating member configured to have first and second modes of operation, the first mode of operation is that the rotating member rotates around the rotation axis with the rotary shaft and the second mode of operation is that the rotary shaft is allowed to rotate relative to the rotating member;

a switch configured to operate the motor;

an operation member configured to move between an ON position and an OFF position according to an external depressing operation, the operation member in the ON position holding the switch in an ON state and the operation member in the OFF position holding the switch in an OFF state; and a lock mechanism configured to allow the rotating member to rotate around the rotation axis when the operation member is in the ON position and to prevent the rotating member from rotating around the rotation axis when the operation member is in the OFF position, wherein:

the rotary shaft and the rotating member are configured to transmit torque between the rotary shaft and the rotating member;

the rotating member is configured to (1) rotate with the rotary shaft in the first mode of operation by action of transmitting the torque when the operation member is moved from the OFF position to the ON position and the lock mechanism allows the rotating member to rotate and (2) apply a braking force to the rotary shaft in the second mode of operation by action of transmitting the torque when the operation member is moved from the ON position to the OFF position and the lock mechanism prevents rotation of the rotating member.

2. The work tool as defined in claim 1, wherein:

the lock mechanism includes:

a cylindrical member radially outside of the rotating member; and an engagement member that is movable in a circumferential direction around the rotation axis between the cylindrical member and the rotating member and configured to move, in interlock with movement of the operation member, between an engaged position and a disengaged position, the engagement member in the engaged position is held between the cylindrical member and the rotating member and the engagement member in the disengaged position is loosely positioned between the cylindrical member and the rotating member;

rotation of the cylindrical member around the rotation axis is restricted; and the engagement member is configured to be placed (1) in the disengaged position to allow rotation of the rotating member when the operation member is placed in the ON position and (2) in the engaged position to prevent the rotating member from rotating when the operation member is placed in the OFF position.

3. The work tool as defined in claim 2, wherein:

the lock mechanism includes a retaining member configured to retain the engagement member, the retaining member is connected to the operation member and radially outside of the rotating member and radially inside of the cylindrical member so as to be rotatable around the rotation axis within a specified rotation range, and the retaining member is configured to move the engagement member between the engaged position and the disengaged position in the circumferential direction by rotating around the rotation axis in interlock with movement of the operation member.

4. The work tool as defined in claim 3, wherein:

the lock mechanism further includes a first biasing member configured to bias the retaining member in a first rotation direction, and the retaining member is configured to:

place the engagement member in the engaged position by being rotated to a first retaining position in the first rotation direction by a biasing force of the first biasing member, in interlock with the movement of the operation member from the ON position to the OFF position, and place the engagement member in the disengaged position by being rotated to a second retaining position in a second rotation direction against the biasing force, in interlock with the movement of the operation member from the OFF position to the ON position, the second direction being opposite to the first rotation direction.

5. The work tool as defined in claim 1, wherein:

the rotary shaft has a first frictional-engagement part having a first friction surface, the rotating member has a second frictional-engagement part having a second friction surface, and the torque is transmitted between the rotating member and the rotary shaft by friction between the first friction surface and the second friction surface.

6. The work tool as defined in claim 5, wherein:

the first frictional-engagement part and the second frictional-engagement part are side by side in the rotation axis direction, the work tool comprises a second biasing member configured to bias at least one of the first frictional-engagement part and the second frictional-engagement part in a direction to bring the first friction surface and the second friction surface into contact, and the first friction surface and the second friction surface are normally held in contact with each other by a biasing force of the second biasing member.

7. The work tool as defined in claim 5, wherein:

each of the first frictional-engagement part and the second frictional-engagement part is a friction plate, the first friction surface is on a side surface of the first frictional-engagement part and the second friction surface is on a side surface of the second frictional-engagement part; and a plurality of the first frictional-engagement parts and a plurality of the second frictional-engagement parts alternate along the rotation axis direction.

8. The work tool as defined in claim 1, wherein the lock mechanism is configured to be switched from a lock state of preventing rotation of the rotating member to an unlock state of allowing the rotating member to rotate before the operation member reaches the ON position from the OFF position.

9. The work tool as defined in claim 1, wherein:

the motor includes a stator, a rotor and a motor shaft extending from the rotor, the rotary shaft and the motor shaft are coaxially connected by a conical tapered part in one end portion of one of the rotary shaft and the motor shaft and a conical tapered hole in one end portion of the other of the rotary shaft and the motor shaft.

10. The work tool as defined in claim 9, further comprising:

a motor housing that houses the motor such that the motor shaft extends in a front-rear direction, a rear end portion of the motor housing having an opening, wherein:

the rotary shaft is connected to a rear end portion of the motor shaft and extends rearward through the opening, and the work tool further comprises a dustproof member fixed to the rotary shaft rearward of the opening and configured to prevent dust from entering the motor housing through the opening.

11. A work tool configured to rotationally drive a tool accessory, the work tool comprising:

a motor;

a tool-mounting part configured to removably receive the tool accessory and to rotate by power of the motor;

a rotary shaft configured to rotate around a rotation axis with the tool-mounting part by the power of the motor;

a switch configured to operate the motor;

an operation member configured to move between an ON position and an OFF position according to an external depressing operation, the operation member in the ON position holding the switch in an ON state and the operation member in the OFF position holding the switch in an OFF state; and a brake system configured to brake the rotary shaft, wherein:

the brake system includes a first brake mechanism and a second brake mechanism configured to operate in series, the first brake mechanism is configured to actuate the second brake mechanism in interlock with movement of the operation member from the ON position to the OFF position, the second brake mechanism is configured to be actuated by the first brake mechanism to apply a braking force to the rotary shaft the second brake mechanism is a frictional brake mechanism including a first frictional-engagement part and a second frictional-engagement part, the first frictional-engagement part is configured to rotate with the rotary shaft and the second frictional-engagement part is normally held in contact with the first frictional-engagement part, the first brake mechanism is a lock mechanism including an engagement member configured to be engageable with the second frictional-engagement part, the engagement member is configured to stop rotation of the second frictional-engagement by engaging the second frictional-engagement part in interlock with movement of the operation member from the ON position to the OFF position, and the second frictional-engagement part is configured to apply the braking force to the rotary shaft via the first frictional-engagement part when the engagement member stops rotation of the second frictional-engagement part.

12. The work tool as defined in claim 11, wherein:

the second brake mechanism includes a torque-transmission part configured to transmit torque to and from the rotary shaft, and the second brake mechanism includes a dustproof structure configured to prevent dust from entering the torque transmission part.

* * * * *